US012441567B2

(12) United States Patent
Yamamoto

(10) Patent No.: US 12,441,567 B2
(45) Date of Patent: Oct. 14, 2025

(54) SHEET FEEDING DEVICE AND IMAGE FORMING APPARATUS INCORPORATING THE SHEET FEEDING DEVICE

(71) Applicant: Kazuya Yamamoto, Kanagawa (JP)

(72) Inventor: Kazuya Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 170 days.

(21) Appl. No.: 18/230,671

(22) Filed: Aug. 7, 2023

(65) Prior Publication Data

US 2024/0051775 A1 Feb. 15, 2024

(30) Foreign Application Priority Data

Aug. 9, 2022 (JP) ..... 2022-126983
May 16, 2023 (JP) ..... 2023-080899

(51) Int. Cl.
*B65H 7/14* (2006.01)
*B65H 3/06* (2006.01)

(52) U.S. Cl.
CPC ..... *B65H 7/14* (2013.01); *B65H 3/0669* (2013.01); *B65H 3/0684* (2013.01); *B65H 2301/44318* (2013.01); *B65H 2553/40* (2013.01)

(58) Field of Classification Search
CPC ..... B65H 7/14; B65H 7/06
See application file for complete search history.

(56) References Cited

U.S. PATENT DOCUMENTS 6,151,478 A * 11/2000 Katsuta ..... H04N 1/00602 399/374
7,292,819 B2 * 11/2007 Ueda ..... B65H 7/00 271/259
8,038,140 B2 * 10/2011 Kimura ..... B65H 7/18 271/4.03
8,444,135 B2 * 5/2013 Morita ..... B65H 3/0607 271/265.01
11,142,417 B2 * 10/2021 Matsumura ..... B65H 7/06
11,286,128 B2 * 3/2022 Matsumoto ..... B65H 1/04
11,356,574 B2 * 6/2022 Yoshikaie ..... H04N 1/04
12,071,321 B2 * 8/2024 Noji ..... G03G 15/50
2008/0106030 A1 5/2008 Takenaka
(Continued)

FOREIGN PATENT DOCUMENTS

JP 2005022792 A * 1/2005
JP 2008-114980 A 5/2008
JP 2020-050487 A 4/2020

*Primary Examiner* — Patrick Cicchino
(74) *Attorney, Agent, or Firm* — XSENSUS LLP

(57) ABSTRACT

A sheet feeding device includes a sheet stacker, first and second feeders, a separation member, first and second sensors, and circuitry. The sheet stacker stacks multiple sheets including a sheet. The first and second feeder feed the sheet stacked on the sheet stacker in a sheet conveyance direction. The separation member contacts the second feeder to form a nip region. The first and second sensors detect the first or second sheet. The circuitry is to determine that a trailing end of the first sheet reaches at a given position downstream from the first sensor, and start feeding the second sheet in response to detecting the trading end of the first sheet by the second sensor, detecting the trailing end of the first sheet by the first sensor, or determining that the trailing end of the first sheet reaches at the given position.

14 Claims, 7 Drawing Sheets

(56) References Cited

U.S. PATENT DOCUMENTS

| | | | | |
|---|---|---|---|---|
| 2010/0052248 | A1* | 3/2010 | Fushimi | B65H 9/006 271/227 |
| 2010/0225045 | A1* | 9/2010 | Kimura | B65H 3/0684 271/10.09 |
| 2021/0214176 | A1 | 7/2021 | Fukushima et al. | |
| 2021/0221636 | A1 | 7/2021 | Wakabayashi et al. | |

* cited by examiner

SHEET FEEDING DEVICE AND IMAGE FORMING APPARATUS INCORPORATING THE SHEET FEEDING DEVICE

CROSS-REFERENCE TO RELATED APPLICATIONS

This patent application is based on and claims priority pursuant to 35 U.S.C. § 119(a) to Japanese Patent Application Nos. 2022-126983, filed on Aug. 9, 2022, and 2023-080899, filed on May 16, 2023, in the Japan Patent Office, the entire disclosure of each of which is hereby incorporated by reference herein.

BACKGROUND

Technical Field

Embodiments of the present disclosure generally relate to a sheet feeding device and an image forming apparatus incorporating the sheet feeding device, and more particularly, to a sheet feeding device that feeds a sheet such as a sheet of paper, a transfer sheet, or an original document, and to an image forming apparatus that includes the sheet feeding device and forms an image on a recording medium. Such an image forming apparatus is, for example, a copier, a printer, a facsimile machine, or a multifunction peripheral having at least two of copying, printing, scanning, facsimile, and plotter functions.

Background Art

Various types of image forming apparatuses such as copiers, printers, and printing machines are known that include a sheet feeding device that feeds a sheet such as a paper and an original document in a predetermined sheet conveyance direction.

On the other hand, an image forming apparatus including such a sheet feeding device includes a technique performed with the configuration provided with a first document sensor (i.e., a first detection sensor) disposed downstream from a separation nip region (nip) of a, sheet separation roller pair (including a sheet feed roller and a sheet separation roller) in the sheet conveyance direction and a second document sensor (i.e., a second detection sensor) disposed upstream from the separation nip region of the sheet separation roller pair in the sheet conveyance direction. When at least one of the first document sensor or the second document sensor is changed from a detection state to a non-detection state with respect to the preceding document (i.e., the preceding sheet), a subsequent document (i.e., a subsequent sheet) starts to be fed.

SUMMARY

Embodiments of the present disclosure described herein provide a novel sheet feeding device apparatus including a sheet stacker, a first feeder, a second feeder, a separation member, a first sensor, a second sensor, and circuitry. The sheet stacker stacks multiple sheets including a first sheet and a second sheet below the first sheet on the sheet stacker. The first feeder is over the sheet stacker to feed the multiple sheets on the sheet stacker in a sheet conveyance direction. The second feeder is downstream from the first feeder in the sheet conveyance direction to feed the multiple sheets fed from the first feeder in the sheet conveyance direction. The separation member contacts the second feeder to form a nip region. The first sensor is disposed downstream from the nip region in the sheet conveyance direction to detect the first sheet or the second sheet. The second sensor is disposed downstream from the first feeder and upstream from the nip region in the sheet conveyance direction to detect the first sheet or the second sheet. The circuitry is to determine that a trailing end of the first sheet reaches at a given position downstream from the first sensor in the sheet conveyance direction, and start feeding the second sheet following the first sheet in response to one of (1) detecting the trailing end of the first sheet by the second sensor, (2) detecting the trailing end of the first sheet by the first sensor and not detecting the trailing end of the first sheet by the second sensor, and (3) determining that the trailing end of the first sheet reaches at the given position and not detecting the trailing end of the first sheet by the first sensor and the second sensor.

Further, embodiments of the present disclosure described herein provide an image forming apparatus including the above-described sheet feeding device.

BRIEF DESCRIPTION OF THE SEVERAL VIEWS OF THE DRAWINGS

Exemplary embodiments of this disclosure will be described in detail based on the following figures, wherein.

Figure 1:
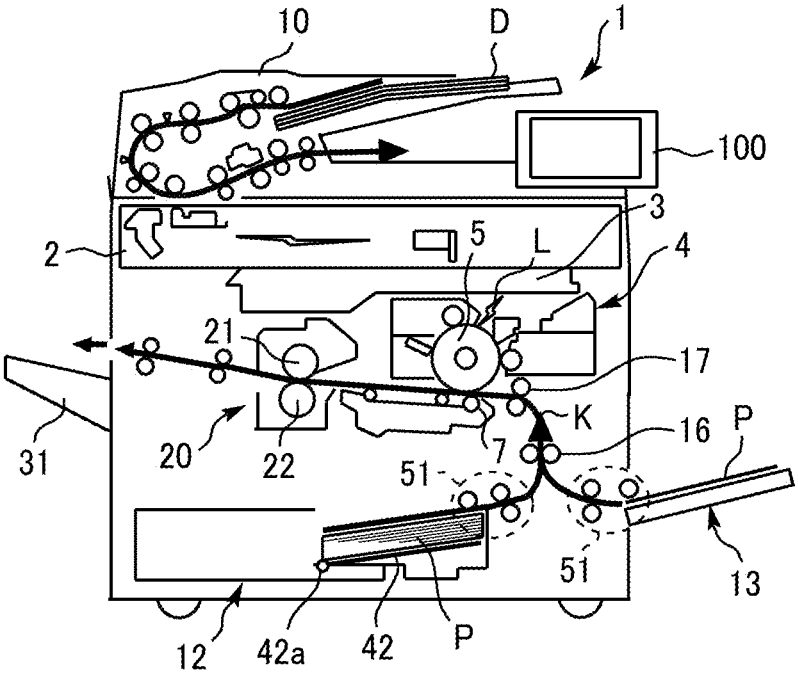
FIG. 1 is a diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to"

another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described below in detail with reference to the drawings. It is to be understood that an identical or similar reference character is given to identical or corresponding parts throughout the drawings, and redundant descriptions are omitted or simplified below.

Initially with reference to FIG. 1, a description is given of the overall configuration and operation of an image forming apparatus 1 according to an embodiment of the present disclosure.

FIG. 1 is a diagram illustrating the overall configuration of an image forming apparatus 1, which is a copier according to an embodiment of the present disclosure.

In another embodiment of the present disclosure, the image forming apparatus 1 may be, for example, a printer, a facsimile machine, or a multifunction peripheral (MFP) having at least two of copying, printing, scanning, facsimile, and plotter functions.

In FIG. 1, the image forming apparatus 1, which is a copier in the present embodiment, includes a document reading device 2, an exposure device 3, an image forming device 4, a transfer device 7 serving as an image forming unit, a document feeding device 10, sheet feeding devices 12 and 13, a downstream conveyance roller pair 16, a registration roller pair 17 serving as a timing roller pair, a fixing device 20, and an ejection tray 31.

The document reading device 2 optically reads image data of an original document D.

The exposure device 3 irradiates a photoconductor drum 5, which is included in the image forming device 4, with exposure light 1, according to the image data read by the document reading device 2.

The image forming device 4 forms a toner image on the photoconductor drum 5.

The transfer device 7 transfers the toner image from the photoconductor 5 onto a sheet P.

The document feeding device 10 is an automatic document feeder (ADF) that conveys the original document D placed on a tray, to the document reading device 2.

Each of the sheet feeding devices 12 and 13 feeds the sheet P accommodated in the corresponding sheet tray. The sheet feeding device 12 is an in-body sheet tray placed inside the housing of the image forming apparatus 1. The sheet feeding device 13 is a bypass sheet feeding device projecting on one side of the housing of the image forming apparatus 1.

The downstream conveyance roller pair 16 is disposed downstream from a sheet feeding assembly 51 in the sheet conveyance direction.

The registration roller pair 17 serving as a timing roller pair conveys the sheet P toward the transfer device 7.

The fixing device 20 includes a fixing roller 21 and a pressure roller 22 to fix the toner image borne as an unfixed image on the sheet P.

The sheet P is ejected from the housing of the image forming apparatus 1 onto the ejection tray 31.

Each of the sheet feeding devices 12 and 13 includes a sheet stacker 42 (i.e., an elevation plate) that is vertically movable, and a sheet feeding assembly 51 serving as a sheet feeding mechanism included in the sheet feeding device 12.

The image forming apparatus 1 further includes an operation display panel 100 for inputting a printing operation to be performed in the image forming apparatus 1 and for displaying the condition of the image forming apparatus 1.

Now, a description is given of regular image forming operations (printing operations) of the image forming apparatus 1 with reference to FIG. 1.

The original document D is conveyed (fed) by conveyance rollers of the document feeding device 10 from the document loading table in a direction indicated by arrow in FIG. 1, and then passes over the document reading device 2. At this time, the document reading device 2 optically reads image data of the original document D passing over the document reading device 2.

The image data optically read by the document reading device 2 is converted into electrical signals. The electrical signals are transmitted to the exposure device 3 serving as a writer. The exposure device 3 then emits the exposure light L such as laser light according to the electrical signals (i.e., the image data) toward the surface of the photoconductor drum 5 of the image forming device 4.

Meanwhile, while the photoconductor drum 5 rotates in a clockwise direction in FIG. 1, the image forming device 4 performs a predetermined series of image forming processes, such as a charging process, an exposing process, and a developing process, to form a toner image corresponding to the image data on the surface of the photoconductor drum 5.

Thereafter, the toner image formed on the surface of the photoconductor drum 5 is transferred by the transfer device 7, onto the sheet P conveyed by the registration roller pair 17. In the present embodiment, a transfer roller (i.e., a roller that forms a transfer nip region by corning into contact with the photoconductor drum 5) is used as the transfer device 7. However, the transfer device 7 is not limited the transfer roller and may be, for example, a wire transfer device using a corona discharging method.

Now, a description is given of how the sheet P is conveyed to the transfer device 7 (image forming portion).

One of the sheet feeding devices 12 and 13 included in the image forming apparatus 1 is automatically or manually selected. For example, the sheet feeding device 12 disposed inside the housing of the image forming apparatus 1 is selected. Then, the sheet feeding assembly 51 feeds the uppermost sheet P of the sheets P accommodated in the sheet feeding device 12, toward a sheet conveyance passage K. The sheet P thus fed then passes through the sheet conveyance passage K along which a downstream conveyance roller pair 16 is disposed and reaches the position where the registration roller pair 17 is located. When the sheet P reaches the registration roller pair 17, the registration roller pair 17 is stopped rotating. As the leading end of the sheet P contacts the nip region formed by the rollers of the registration roller pair 17, skew of the sheet P is corrected.

The timing at which the sheet P is fed to the position of the registration roller pair 17 is grasped by a registration roller detection sensor 63 (see FIG. 3) disposed proximate to the upstream side of the registration roller pair 17.

Then, the registration roller pair 17 starts rotating again, and the sheet P is then conveyed toward the transfer device 7 (i.e., the image forming portion) in synchrony with movement of the toner image formed on the surface of the photoconductor drum 5 for forming the toner image on the sheet P at the correct position. The image formed on the surface of the photoconductor drum 5 is transferred onto the sheet P by the transfer device 7. This process is the transfer process.

After the transfer device 7 transfers the toner image from the photoconductor drum 5 onto the sheet P in the transfer process, the sheet P passes the position of the transfer device 7 to be conveyed to the fixing device 20 along the sheet conveyance passage K. In the fixing device 20, the uppermost sheet P is conveyed between the fixing roller 21 and the pressure roller 22, so that the toner image is fixed to the sheet P by application of heat applied by the fixing roller 21 and pressure applied by the fixing roller 21 and the pressure roller 22. This process is the fixing process. After the sheet. P bearing the toner image fixed in the fixing process is conveyed out from the fixing nip between the fixing roller 21 and the pressure roller 22, the sheet P is ejected from the housing of the image forming apparatus 1 onto the ejection tray 31 as a sheet having an output image.

Thus, a series of the image forming processes (print job) is completed.

A detail description is given below of the sheet feeding device according to the present embodiment, with reference to FIGS. 2 to 4.

The following describes the sheet feeding device 12 included in the housing of the image forming apparatus 1. However, the sheet feeding device 13 serving as a bypass sheet feeding device has substantially the same configuration as the configuration of the sheet feeding device 12 in the image forming apparatus 1, except that the sheet feeding devices 12 and 13 are disposed at different locations and that the sheet feeding device 13 does not include a sheet stacker that is movable in the vertical direction. For this reason, the description of the configuration of the bypass sheet feeding device 13 is omitted.

Figure 2:
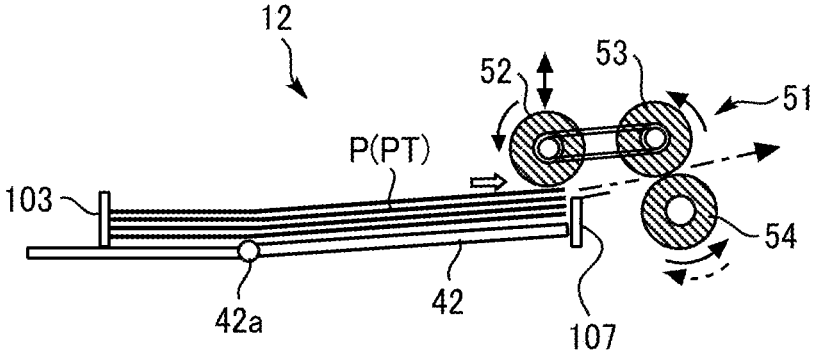
FIG. 2 is a schematic diagram illustrating a configuration of a sheet feeding device included in the image forming apparatus in FIG. 1.

FIG. 2 is a schematic diagram illustrating a configuration of the sheet feeding device 12 included in the image forming apparatus 1 in FIG. 1.

Figure 3:
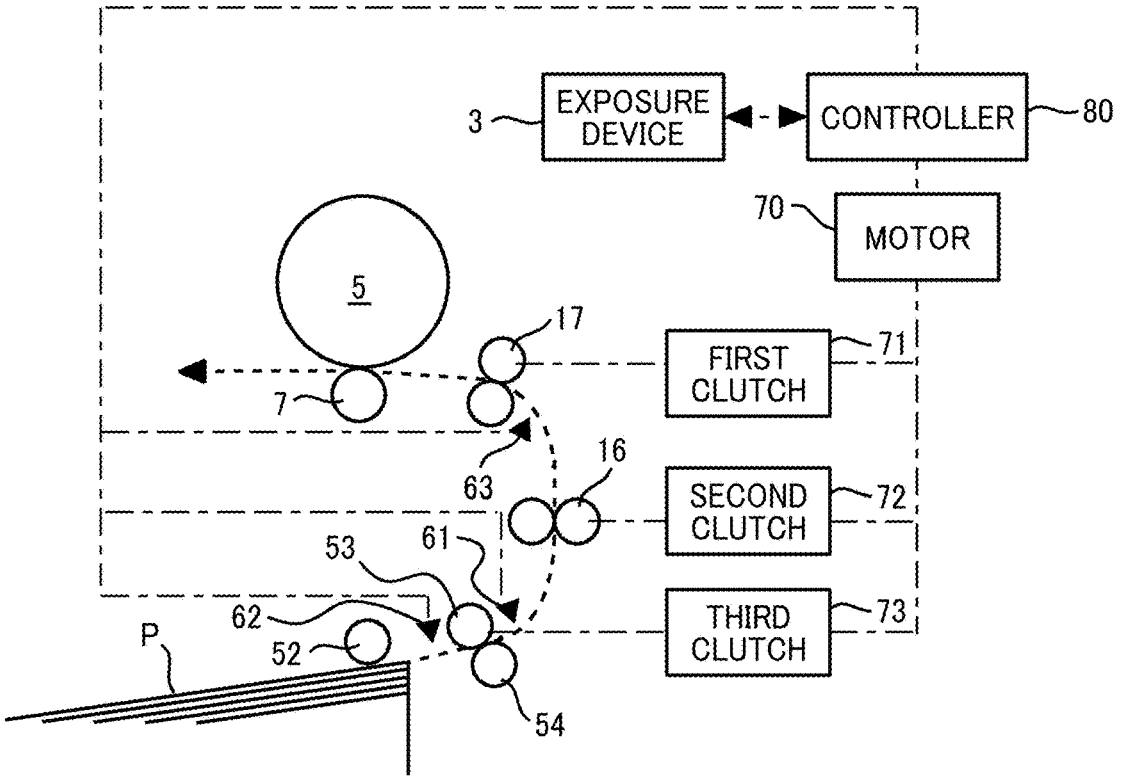
FIG. 3 is a schematic diagram illustrating a sheet conveyance passage extending from the sheet feeding device to a transfer device, and driving members of a conveying mechanism.

FIG. 3 is a schematic diagram illustrating a sheet conveyance passage extending from the sheet feeding device 12 to the transfer device 7 and driving members of a conveying mechanism.

Figure 4:
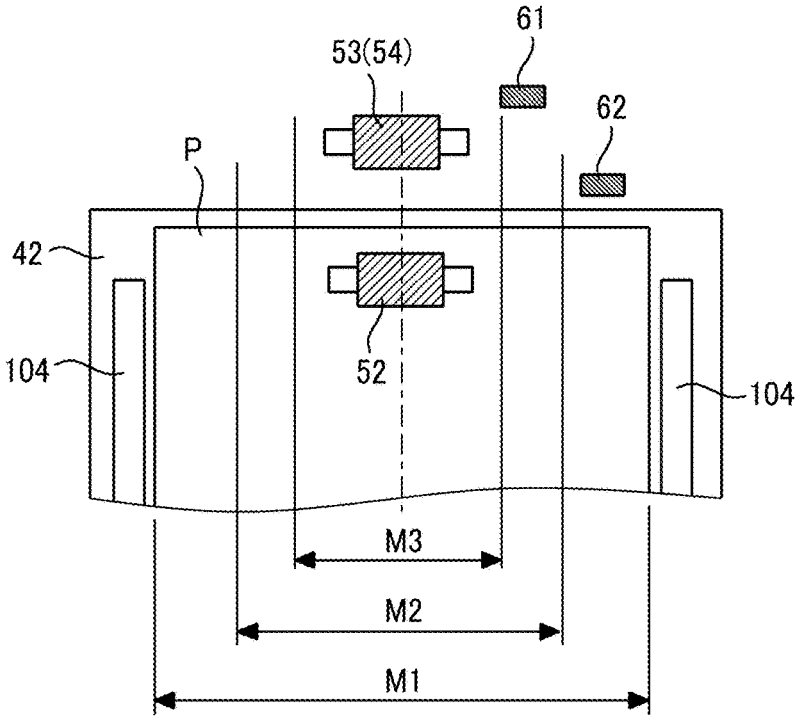
FIG. 4 is a top view of the sheet feeding device of FIG. 2.

FIG. 4 is a top view of the sheet feeding device of FIG. 2.

Referring to FIGS. 2 and 4, the sheet feeding device 12 includes the sheet stacker 42, the sheet feeding assembly 51, a first detection sensor 61, and a second detection sensor 62, The sheet stacker 42 is stackable of multiple sheets P. The sheet feeding assembly 51 feeds the sheet P stacked on the sheet stacker 42. The first detection sensor 61 serves as a first detector or sensor. The second detection sensor 62 serves as a second detector or sensor.

The sheet stacker 42 is partly movable vertically (i.e., in the vertical direction) such that a downstream side (i.e., the right side in FIG. 2) in the sheet conveyance direction of the uppermost sheet P of the sheets P placed on the sheet stacker 42 reaches a given height position, which is a position where the uppermost sheet P contacts a pickup roller 52. Specifically, the sheet stacker 42 includes an elevation plate and a fixed plate. The elevation plate is rotatable around a rotary center shaft 42*a*. The fixed plate is a plate that does not move vertically. The elevation plate is disposed downstream from the fixed plate in the sheet conveyance direction and rotates around the rotary center shaft 42*a* in the forward and reverse directions. By so doing, the elevation plate moves in the vertical direction.

Referring to FIG. 2, the sheet feeding assembly 51 includes, ter example, a pickup roller 52, a sheet feed roller 53 and a sheet separation roller 54, The pickup roller 52 serves as a first sheet feeder. The sheet feed roller 53 (feed roller) serves as a second sheet feeder. The sheet separation roller 54 serves as a separator.

The sheet feed roller 53 serving as a second sheet feeder is disposed proximate to the leading end (i.e., downstream end) of the sheets P stacked on the sheet stacker 42 in the sheet conveyance direction (direction indicted by white arrow in FIG. 2). The sheet feed roller 53 rotates (in the counterclockwise direction in FIG. 2) along the sheet conveyance direction while contacting the upper face of the uppermost sheet P of the sheets P on the sheet stacker 42, so that the sheet P is conveyed in the sheet conveyance direction indicated by the broken arrow in FIG. 2.

As illustrated in FIG. 3, the first detection sensor 61 is disposed downstream from the sheet feed roller 53 in the sheet conveyance direction and the second detection sensor 62 is disposed upstream from the sheet feed roller 53 in the sheet conveyance direction. A detailed description of the first detection sensor 61 and the second detection sensor 62 will be described below.

The pickup roller 52 serving as a first sheet feeder rotates in the counterclockwise direction in FIG. 2 along the sheet conveyance direction while contacting the upper face of the uppermost sheet P stacked on the sheet stacker 42, so that the sheet P is conveyed toward the sheet feed roller 53. The pickup roller 52 can contact and separate from the sheet P (i.e., the uppermost sheet P) stacked on the sheet stacker 42 (i.e., the elevation plate). In other words, the pickup roller 52 is movable between a retracted position at which the pickup roller 52 does not contact the sheet P stacked on the sheet stacker 42 and a contact position at which the pickup roller 52 contacts the sheet P as illustrated in FIG. 2.

The sheet separation roller 54 serving as a separator is disposed to firm a nip region (i.e., a separation portion) with the sheet feed roller 53.

The sheet separation roller 54 rotates in the forward direction, which is the clockwise direction indicated by broken arrow in FIG. 2, along the sheet conveyance direction when a single sheet P is sandwiched in the nip region or when no sheet P is sandwiched in the nip region, By contrast, when multiple sheets P are sandwiched in the nip region, the sheet separation roller 54 rotates in a direction opposite to the above-described forward direction. In other words, the sheet separation roller 54 rotates in the counterclockwise direction indicated by solid arrow in FIG. 2. As a result, the uppermost sheet P of the multiple sheets P sandwiched in the nip region is fed in the sheet conveyance direction along the rotation of the sheet feed roller 53 while the subsequent sheet or sheets P of the multiple sheets P are conveyed in the direction opposite to the sheet conveyance direction (i.e., the forward direction). Thus, the multiple feeding of the sheets P or continuous feeding is reduced or prevented.

In the present embodiment, a plate-shaped separation pad or a roller that does not rotate reversely (i.e., a roller that does not include a reverse rotation mechanism) may be used as the separator instead of the sheet separation roller 54.

In the present embodiment, the pickup roller 52 is a member that is movable in the vertical direction but is not limited to the pickup roller 52 having this configuration. For example, the pickup roller 52 may be a member that is fixed at a given height without moving in the vertical direction. In this case, the sheet stacker 42 moves in the vertical direction so that the uppermost sheet P stacked on the sheet stacker 42 contacts the pickup roller 52 at the fixed position with a given pressure.

In the sheet feeding device 12 according to the present embodiment, the sheet stacker 42 (i.e., the elevation plate) moves in the vertical direction depending on the number of sheets P stacked on the sheet stacker 42 so that the pickup roller 52 can contact the uppermost sheet P placed on top of the sheets P stacked on the sheet stacker 42. Then, the sheet feeding operation of the sheets P starts after the pickup roller 52 is lowered to a position where the pickup roller 52 contacts the upper face of the uppermost sheet P on the sheets P stacked on the sheet stacker 42 (i.e., the elevation plate) whose position in the vertical direction has been adjusted.

Further, the sheet feeding device 12 according to the present embodiment includes side fences 104 (see FIG. 4) as a pair of side fences that regulates the position of the sheet P on the sheet stacker 42 in the width direction of the sheet P. In other words, the side fences 104 regulates the position of the sheet P in the direction perpendicular to the surface of the drawing sheet in FIGS. 2 and 3 and the horizontal direction in FIG. 4. The side fences 104 are disposed at both lateral ends of the sheet P, in other words, at both ends in the width direction of the sheet P, so that the side fences 104 sandwich the sheet P. Due to such a configuration, a manual movement assembly such as the side fences 104 can movably operate simultaneously with each other in the width direction (in other words, the space between the side fences 104 in the width direction can be increased and decreased) in accordance with the size of the sheet P in the width direction.

The sheet feeding device 12 according to the present embodiment further includes a reference fence 107 and an end fence 103 each regulating the position of the sheet P on the sheet stacker 42 in the sheet conveyance direction. The sheet conveyance direction is the horizontal direction, or the left and right directions, in FIG. 2. The reference fence 107 is disposed such that a downstream side face of the sheet P in the sheet conveyance direction (i.e., the leading end of the sheet P in the sheet conveyance direction) contacts the reference fence 107. The end fence 103 is disposed to contact an upstream side face of the sheet P in the sheet conveyance direction (i.e., the trailing end of the sheet P in the sheet conveyance direction). The end fence 103 can be moved by the manual moving assembly in the sheet conveyance direction so as to conform to the size of the sheet P in the sheet conveyance direction.

In the sheet feeding device 12 having the above-described configuration, when the sheet P is not set on the sheet stacker 42, an end detection sensor detects that the sheet P is not set on the sheet stacker 42. In response to the detection, the pickup roller 52 is moved to the retracted position.

When the sheet P is set on the sheet stacker 42, the end detection sensor detects the state that the sheet P is set on the sheet stacker 42. In response to the detection, the pickup roller 52 is moved from the retracted position toward the contact position (i.e., the position illustrated in FIG. 2).

As illustrated in FIG. 2, the pickup roller 52 starts to rotate in the counterclockwise direction while being in contact with the upper face of the uppermost sheet P of the sheets P placed on the sheet stacker 42. At the same time, the sheet feed roller 53 and the sheet separation roller 54 start to rotate. As a result, the pickup roller 52 conveys the uppermost sheet P or upper sheets P of the sheet bundle PT placed on the sheet stacker 42 toward the nip region between the sheet feed roller 53 and the sheet separation roller 54. In the nip region, a single sheet P is separated from the other upper sheets P and is conveyed toward the image forming device.

When the sheets P stacked on the sheet stacker 42 are totally fed out and no sheet is left on the sheet stacker 42, the state of the sheet stacker 42 is detected by the end detection sensor. In response to the detection, the pickup roller 52 is moved to the retracted position again.

In the present embodiment, the sheet feeding assembly 51 (including the pickup roller 52, the sheet feed roller 53, and the sheet separation roller 54), the downstream conveyance roller pair 16, and the registration roller pair 17 are not configured to be driven by independent driving mechanisms (motors), but are configured to be driven by a single driving mechanism (i.e., a motor 70). Due to such a configuration, the cost and size of the image forming apparatus 1 are reduced.

To be more specific, referring to FIG. 3, the registration roller pair 17 is driven by a driving force from the motor 70 via a gear train including a first clutch 71. The downstream conveyance roller pair 16 is driven by the driving force from the motor 70 via a gear train including a second clutch 72. Further, the sheet feeding assembly 51 is driven by the driving force from the motor 70 via a gear train including a third clutch 73. The first clutch 71, the second clutch 72, and the third clutch 73 are independently controlled to be turned on and off under the control of the controller 80. The motor 70 is also driven and controlled by the controller 80.

The controller 80 includes a central processing unit (CPU) and has a timer for measuring time. The controller 80 controls conveyance of the sheet P by controlling the first clutch 71, the second clutch 72, the third clutch 73, and the motor 70 based on the outputs of a first detection sensor 61 and a second detection sensor 62, which will be described below, and the time measured by the timer.

With such a configuration, the sheet feeding assembly 51, the downstream conveyance roller pair 16, and the registration roller pair 17 can be driven and stopped at independent timings.

Referring now to FIGS. 3 to 9, a detailed description is given of a configuration and operation of the sheet feeding device 12 of the image forming apparatus 1 according to the present embodiment.

As described above with reference to FIGS. 2 and 4, the sheet feeding device 12 includes the sheet stacker 42, the pickup roller 52 serving as a first sheet feeder, the sheet feed roller 53 as a second sheet feeder, and the sheet separation roller 54 serving as a separator.

The sheet stacker 42 can stack multiple sheets P.

The pickup roller 52 as a first sheet feeder is a roller that feeds the sheet P stacked on the sheet stacker 42 in the sheet conveyance direction (indicated by white arrow in FIG. 2).

The sheet feed roller 53 as a second sheet feeder is a roller that further feeds the sheet P conveyed by the pickup roller 52 (i.e., the first sheet feeder) in the sheet conveyance direction.

The sheet separation roller 54 as a separator is a roller that contacts the sheet feed roller 53 (i.e., the second sheet feeder) to form a nip region (i.e., a separation portion).

A description is given now of the configuration of the sheet feeding device 12, with reference to the drawings including FIGS. 3 and 4.

As described above, FIG. 3 is a schematic diagram illustrating a sheet conveyance passage extending from the sheet feeding device 12 to a transfer portion and driving members of a conveying mechanism, and FIG. 4 is a top view of the sheet feeding device 12.

As illustrated in FIGS. 3 and 4, the first detection sensor 61 (i.e., a nip exit sensor) serving as a first detector capable of detecting the sheet P is disposed downstream from (or proximate to) the nip region (i.e., the separation portion) formed between the sheet feed roller 53 and the sheet separation roller 54 in the sheet conveyance direction.

Further, the second detection sensor 62 (i.e., a nip entrance sensor) as a second detector capable of detecting the sheet is disposed downstream from the pickup roller 52 (i.e., the first sheet feeder) in the sheet conveyance direction and upstream from the nip region (i.e., the separation portion) in the sheet conveyance direction.

In the present embodiment, the downstream conveyance roller pair 16 (see FIG. 3, for example) is disposed downstream from the sheet feed roller 53 (i.e., the second sheet feeder) in the sheet conveyance direction. The first detection sensor 61 (i.e., the first detector or sensor) is disposed downstream from or close to the downstream side of the nip region (i.e., the separation portion) in the sheet conveyance direction and upstream from the downstream conveyance roller pair 16 in the sheet conveyance direction.

Each of the first detection sensor 61 and the second detection sensor 62 is a reflective photosensor that optically detects whether the sheet P is present at the position of each sensor. Due to such a configuration, when the state where the first detection sensor 61, the second detection sensor 62, or both detect that no sheet is present at the position of any of the first detection sensor 61 and the second detection sensor 62 (i.e., a no sheet detection state) is changed to the state where the first detection sensor 61, the second detection sensor 62, or both detect that a sheet is present at the position of any of the first detection sensor 61 and the second detection sensor 62 (i.e., a sheet detected state), the leading end of the sheet P is detected. On the other hand, when the state where the first detection sensor 61, the second detection sensor 62, or both detect that a sheet is present at the position of any of the first detection sensor 61 and the second detection sensor 62 (i.e., the sheet detection state) is changed to the state where the first detection sensor 61, the second detection sensor 62, or both detect that no sheet is present at the position of any of the first detection sensor 61 and the second detection sensor 62 (i.e., the no sheet detected state), the trailing end of the sheet P is detected.

In the present embodiment, the first detection sensor 61 (i.e., the first detector or sensor) and the second detection sensor 62 (i.e., the second detector or sensor) employ reflective photosensors but are not limited to the structure. For example, a configuration including a feeler that oscillates (displaces) when the feeler comes into contact with the conveyed sheet P and a transmissive photosensor that optically detects the oscillation of the feeler may be used.

Figure 5A:
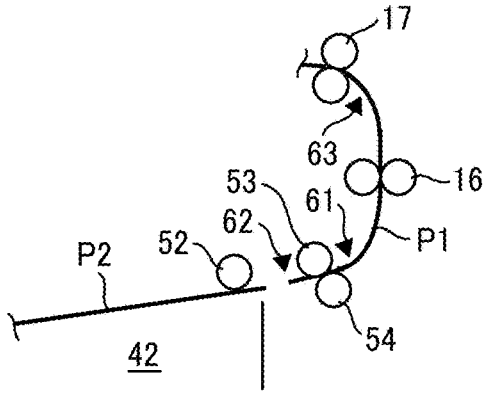
FIGS. 5A, 5B, and 5C are schematic diagrams illustrating three modes for detecting the trailing end of a preceding sheet.
Figure 5B:
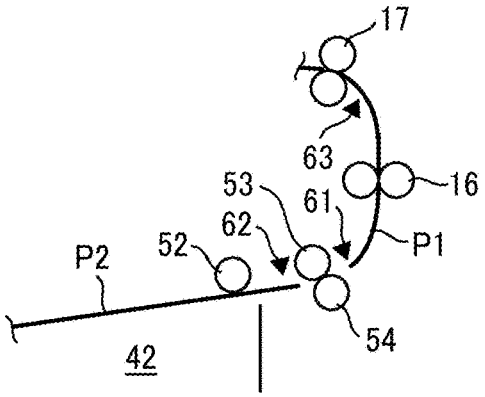
Figure 5C:
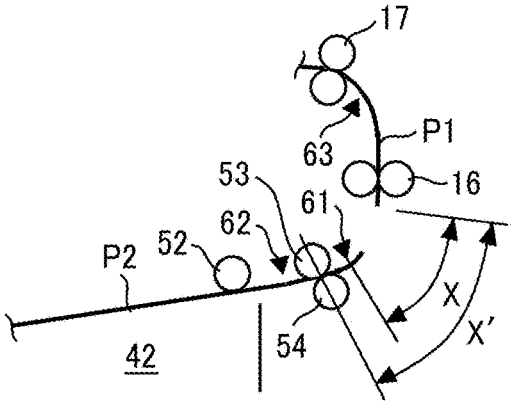

The sheet feeding device 12 (the image forming apparatus 1) according to the present embodiment includes a determination unit that can determine the state where the trailing end of the sheet P reaches a predetermined position separated downstream from the first detection sensor 61 (i.e., the first detector or sensor) by a given distance X in the sheet conveyance direction, in other words, the state illustrated in FIG. 5C with respect to a sheet P1).

Figure 6:
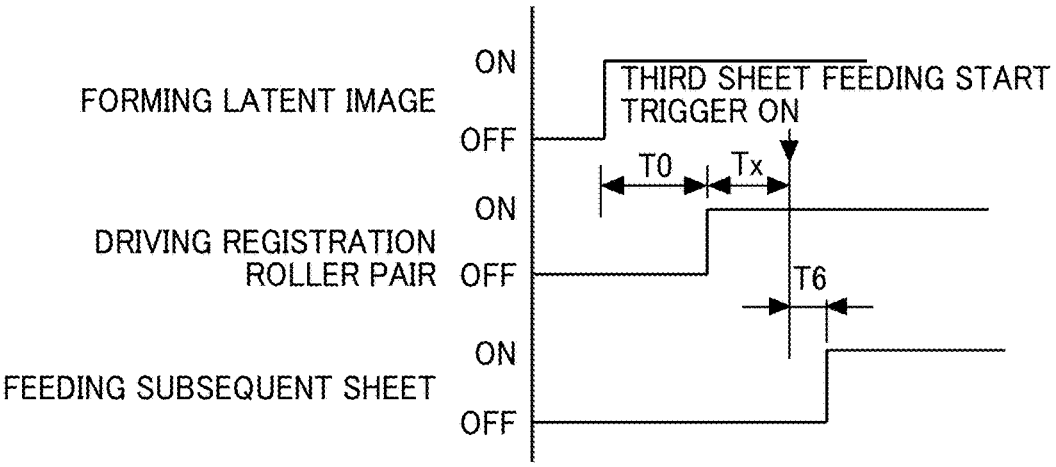
FIG. 6 is a timing chart of a control process to start feeding a subsequent sheet in response to a driving start timing of a registration roller pair.

More specifically, referring to FIG. 6, when a given time Tx that is changed by the sheet length (i.e., the size of the sheet P in the sheet conveyance direction) and the sheet conveyance speed (i.e., the sheet conveyance speed that can be changed depending on the sheet thickness and the fixing temperature) has elapsed since the start of conveyance of the sheet P (particularly, the preceding sheet P1 in FIG. 5C) toward downstream (i.e., the transfer device 7) in the sheet conveyance direction by the registration roller pair 17, the determination unit determines that the trailing end of a preceding sheet P1 (the sheet P) reaches a predetermined position (i.e., a position downstream from the first detection sensor 61 by the given distance X and from the nip region by a given distance X' in the sheet conveyance direction).

The distance between the registration roller pair 17 and the given position is unchanged and does not affect the "given time Tx". On the other hand, the "given time Tx" increases as the sheet length becomes longer, and the "given time Tx" increases as the conveyance speed becomes slower. When the "given time Tx" has elapsed since the start of rotation of the registration roller pair 17 while the registration roller pair 17 nips the leading end of the sheet P, the determination unit determines that the trailing end of the sheet P reaches the given position that is downstream from the first detection sensor 61 by the given distance X.

The above-described term "given position" can be set at a position between the first detection sensor 61 and the registration roller detection sensor 63 (see FIG. 3) described below. In FIG. 5C, a position before the downstream conveyance roller pair 16 is set as the given position. However, the given position may be a position between the downstream conveyance roller pair 16 and the registration roller detection sensor 63.

To be more specific, FIG. 6 is a timing chart of a control to start feeding a subsequent sheet in response to a driving start timing of the registration roller pair 17. Referring to FIG. 6, the image forming apparatus 1 according to the present embodiment is a monochrome image forming apparatus. In response to the timing of the start of a writing of a latent image from the exposure device 3 to the photoconductor drum 5 with exposure light L, the image forming apparatus 1 restarts the driving of the registration roller pair 17 that has been stopped, after a given time TO has elapsed. By so doing, the timing comes to synchronize with the timing of transferring the image on the photoconductor drum 5 onto the sheet P that is conveyed by the registration roller pair 17. Since such control is performed by the controller 80, the controller 80 functions as the "determination unit".

For example, in the present embodiment, the driving of the registration roller pair 17 is started in response to the timing at which the latent image is written with the exposure light L. However, the driving of the registration roller pair 17 may be started in response to a timing other than the timing at which the latent image is written with the exposure light L. For example, the driving of the registration roller pair 17 may be started in response to a timing of detection of a color image formed on an intermediate transferor in a color image forming apparatus that includes multiple photoconductor drums.

Further, in the present embodiment, the "determination unit" is based on the driving start timing of the registration roller pair 17 is used. However, the determination unit is not limited to this configuration. As long as the determination unit can determine the state where the trailing end of the sheet P reaches the given position, various kinds of determination units may be used. (One of such determination units is described below as a modification, with reference to FIGS. 10 and 11.) Further, as described above, the registration roller detection sensor 63 (see FIG. 3) for detecting the timing at which the sheet P is conveyed to the position of the registration roller pair 17 is provided at a position proximate to and upstream from the registration roller pair 17 in the sheet conveyance direction. The registration roller detection sensor 63 may be used as a determination unit.

FIGS. 5A, 5B, and 5C are schematic diagrams illustrating three modes for detecting the trailing end of a preceding sheet P1.

As illustrated in FIG. 5A, when the trailing end of the preceding sheet P1 is detected by the second detection sensor 62 (i.e., the second detector or sensor), the sheet feeding device 12 (the image forming apparatus 1) according to the present embodiment starts feeding the subsequent sheet P2 (in other words, the uppermost sheet placed on top of the sheets P stacked on the sheet stacker 42) in response to the detection timing (i.e., a first sheet feeding start trigger).

The control over such a sheet feeding start of the subsequent sheet P2 in response to the detection of the trailing end of the preceding sheet P1 by the second detection sensor 62 is the control executed when the leading end of the subsequent sheet P2 is not conveyed (continuously together with the preceding sheet P1) to the position of the second detection sensor 62, as illustrated in FIG. 5A. Further, the detection of the trailing end of the preceding sheet P1 by the second detection sensor 62 at this time is performed before detection of the trailing end of the preceding sheet P1 by the first detection sensor 61 or determination of the position of the trailing end of the preceding sheet P1 by the determination unit (i.e., the controller 80).

On the other hand, as illustrated in FIG. 5B, when the trailing end of the preceding sheet P1 is not detected by the second detection sensor 62 (i.e., the second detector or sensor) and the trailing end of the preceding sheet P1 is detected by the first detection sensor 61 (i.e., the first detector or sensor), the sheet feeding device 12 (the image forming apparatus 1) according to the present embodiment starts feeding the subsequent sheet P2 (in other words, the uppermost sheet placed on the sheets P on the sheet stacker 42) in response to the detection timing (i.e., a second sheet feeding start trigger).

The control over such a sheet feeding start of the subsequent sheet P2 in response to the detection of the trailing end of the preceding sheet P1 by the first detection sensor 61 is the control executed when the leading end of the subsequent sheet P2 is continuously conveyed to the position of the second detection sensor 62 and detection of the trailing end of the preceding sheet P1 by the second detection sensor 62 cannot be performed, as illustrated in FIG. 5B, Further, the detection of the trailing end of the preceding sheet P1 by the first detection sensor 61 at this time is performed as a workaround (second best solution) in case when the detection of the trailing end of the preceding sheet P1 by the second detection sensor 62 cannot be performed and is performed before determination of the position of the trailing end of the preceding sheet P1 by the determination unit (i.e., the controller 80). The control over such a sheet feeding start of the subsequent sheet P2 in response to the detection of the trailing end of the preceding sheet P1 by the first detection sensor 61 can start (proceed) the feeding of the subsequent sheet P2 even when the leading end of the subsequent sheet P2 is conveyed (continuously together with the preceding sheet P1) to the position of the second detection sensor 62. Accordingly, when such control is executed, no sheet feeding failure of the subsequent sheet P2 while being continuously conveyed with the preceding sheet P1 can be prevented.

On the other hand, as illustrated in FIG. 5C, when the trailing end of the preceding sheet P1 is not detected by the first detection sensor 61 (i.e., the first detector or sensor) and the determination unit (i.e., the controller 80) determines that the trailing end of the preceding sheet P1 reaches the given position the position downstream from the first detection sensor 61 by the given distance X), the sheet feeding device 12 (the image forming apparatus 1) according to the present embodiment starts feeding the subsequent sheet P2 (in other words, the uppermost sheet placed on the sheets P on the sheet stacker 42) in response to the detection timing (i.e., a third sheet feeding start trigger).

The control over such a sheet feeding start of the subsequent sheet P2 in response to the determination of the position of the trailing end of the preceding sheet P1 by the determination unit (i.e., the controller 80) is the control executed when the leading end of the subsequent sheet P2 is conveyed (continuously together with the subsequent sheet P2) to the position of the first detection sensor 61 and detection of the trailing end of the preceding sheet P1 by the first detection sensor 61 (and the second detection sensor 62) cannot be performed, as illustrated in FIG. 5C. Further, the determination of the position of the trailing end of the preceding sheet P1 by the determination unit (i.e., the controller 80) at this time is performed as a final solution (ultimate solution) in case when neither the second detection sensor 62 nor the first detection sensor 61 can detect the trailing end of the preceding sheet P1. The control over such a sheet feeding start of the subsequent sheet P2 in response to the determination of the position of the trailing end of the preceding sheet P1 by the determination unit (i.e., the controller 80) can start (proceed) the feeding of the subsequent sheet P2 even when the leading end of the subsequent sheet P2 is conveyed (continuously together with the preceding sheet P1) to the position of the first detection sensor 61. Accordingly, when such control is executed, no sheet feeding failure of the subsequent sheet P2 while being continuously conveyed with the preceding sheet P1 can be prevented.

The above-described term "given position" is preferably a position at which the leading end of the subsequent sheet P2 cannot reach even when the subsequent sheet P2 is continuously conveyed to the extreme downstream side.

To be more specific, in the present embodiment, as described above with reference to FIG. 6, the determination unit (i.e., the controller 80) determines (recognizes) that the trailing end of the preceding sheet P1 reaches the given position (i.e., the position illustrated in FIG. 5C) when the given time Tx has elapsed from the start of the driving of the registration roller pair 17. By so doing, the sheet feeding device 12 (the image forming apparatus 1) executes the control over the sheet feeding start of the subsequent sheet. P2 in response to the timing as the "third sheet feeding start trigger". In the present embodiment, as illustrated in FIG. 6, the feeding of the subsequent sheet P2 (the driving of sheet feeding assembly 51) is started after a certain time T6 has elapsed from the "third sheet feeding start trigger" is turned on.

The time T6 is equal to or longer than 0 seconds and is determined in consideration of, for example, a margin for control and the sheet feeding productivity to be achieved. In addition, when the conveyance speed of the sheet P is changed as described above, the time T6 may be changed to an optimum time accordingly. The above-described configurations may also be applied to times T1 to T5, which are described below with reference to FIGS. 7 and 8.

As described above, in the present embodiment, the feeding of the subsequent sheet P2 is started in response to the detection timing (or determination timing) of one unit that can detect (or determine) the trailing end of the preceding sheet P1 among the first detection sensor 61, the second detection sensor 62, and the determination unit (i.e., the controller 80), in accordance with whether the subsequent sheet P2 is conveyed continuously together with the preceding sheet P1 and how far the subsequent sheet P2 is conveyed. For this reason, a failure of feeding of the subsequent sheet P2 is less likely to occur regardless of whether the subsequent sheet P2 is conveyed continuously together with the preceding sheet P1 and how far the subsequent sheet P2 is conveyed.

Further, in the present embodiment, the sheet feeding device 12 (the image forming apparatus 1) includes three units (i.e., the first detection sensor 61, the second detection sensor 62, and the determination unit (the controller 80)) that can detect the trailing end of the preceding sheet P1 at the position separated from each other in the sheet conveyance direction. Due to such a configuration, it is less likely that the space between the adjacent sheets (i.e., the preceding sheet P1 and the subsequent sheet P2) becomes too large regardless of the position of the subsequent sheet P2 (in other words, regardless of whether the subsequent sheet P2 is conveyed continuously together with the preceding sheet P1 and how far the subsequent sheet P2 is conveyed). As a result, the productivity when the sheets are continuously conveyed can be enhanced. For example, in a case where the second detection sensor 62 is not included in the sheet feeding device 12, the space between the sheets may increase by the distance between the pickup roller 52 and the first detection sensor 61 at the maximum. The present embodiment, however, provides the three units that can detect the trailing end of the preceding sheet P1 at the position separated from each other in the sheet conveyance direction. For this reason, such a failure is less likely to occur.

In the present embodiment, in the control using the first detection sensor 61, the second detection sensor 62, and the determination unit (i.e., the controller 80), when the first detection sensor 61 (i.e., the fir or sensor) is changed from the state where the first detection sensor 61 does not detect the subsequent sheet P2 to the state where the first detection sensor 61 detects the subsequent sheet P2 (in other words, when the first detection sensor 61 detects the leading end of the subsequent sheet P2), the sheet feeding device 12 (the image forming apparatus 1) temporarily stops the feeding of the subsequent sheet P2, and resumes the feeding of the subsequent sheet P2 (the driving of the sheet feeding assembly 51) after the determination unit (i.e., the controller 80) determines that the trailing end of the preceding sheet P1 reaches the given position (i.e., the position illustrated in FIG. 50. This control corresponds to steps S10 to S13 in the flowchart of FIG. 8, which is described below.

Such control is executed in order to avoid a situation in which a space (gap) between the preceding sheet P1 and the subsequent sheet P2 is too short between the sheet feed roller 53 and the sheet separation roller 54 (i.e., the separation portion) and the registration roller pair 17 and results in a conveyance failure of the preceding sheet P1 and the subsequent sheet P2.

Further, in the present embodiment, in the control using the first detection sensor 61, the second detection sensor 62, and the determination unit (i.e., the controller 80), when the second detection sensor 62 (i.e., the second detector or sensor) is changed from the state where the second detection sensor 62 does not detect the subsequent sheet P2 to the state where the second detection sensor 62 detects the subsequent sheet P2 (in other words, when the second detection sensor 62 detects the leading end of the subsequent sheet P2) after the feeding of the subsequent sheet P2 is started in response to the detection of the second detection sensor 62 (i.e., the second detector or sensor), the sheet feeding device 12 (the image forming apparatus 1) temporarily stops the feeding of the subsequent sheet P2 when the first detection sensor 61 (i.e., the first detector or sensor) detects the preceding sheet P1, and resumes the feeding of the subsequent sheet P2 (the driving of the sheet feeding assembly 51) after the first detection sensor 61 is changed from the state where the first detection sensor 61 detects the preceding sheet P1 (in other words, the trailing end of the preceding sheet P1) to the state where the first detection sensor 61 does not detect the preceding sheet P1. This control corresponds to steps S3 to S8 in the flowchart of FIG. 7, which is described below.

Such control is executed in order to avoid a situation in which a space (gap) between the preceding sheet P1 and the subsequent sheet P2 is too short between the second detection sensor 62 and the first detection sensor 61 and results in a conveyance failure of the preceding sheet P1 and the subsequent sheet P2.

With reference to FIG. 4, in the present embodiment, the first detection sensor 61 (i.e., the first detector or sensor) is disposed at a position separated from the center position in the width direction. The width direction is a direction orthogonal to the sheet conveyance direction and a horizontal direction (left and right directions) in FIG. 4. The center position is a position indicated by a broken line in FIG. 4 and corresponding to the widthwise center position of the sheet P to be conveyed. The first detection sensor 61 is detectable of a sheet P having the size equal to or greater than a first width size M2 (for example, an A5 size sheet).

On the other hand, the second detection sensor 62 (i.e., the second detector or sensor) is disposed at a position closer to an end (on the right side in FIG. 4) than the first detection sensor 61 in the width direction. The second detection sensor 62 is detectable of a sheet P having the size equal to or greater than a second width size M1 (for example, an A4 size sheet) that is greater than the first width size M2.

Accordingly, if the sheet P has the widthwise size beyond the second width size M1, the first detection sensor 61 and the second detection sensor 62 can detect the sheet P. However, the first detection sensor 61 and the second detection sensor 62 cannot detect a sheet P having a width size M3 that does not reach the widthwise position.

As described above, the first detection sensor 61 and the second detection sensor 62 cannot detect a sheet P having the size smaller than the first width size M2 (for example, an A6 size sheet), so as to prevent a circumstance in which components such as the sheet feed roller 53 and the sheet separation roller 54 disposed near the widthwise center and a bracket for holding the sheet feed roller 53 and the sheet separation roller 54 are in the way and a space for installing the first detection sensor 61 and the second detection sensor 62 cannot be obtained.

Further, the first detection sensor 61 and the second detection sensor 62 are disposed not at the same position in the width direction but at different positions in the width direction, so as to prevent a circumstance in which the space between of the first detection sensor 61 and the second detection sensor 62 in the sheet conveyance direction (i.e., the vertical direction in FIG. 4) is relatively small and the first detection sensor 61 and the second detection sensor 62 are likely to interfere with each other if the first detection sensor 61 and the second detection sensor 62 are disposed at the positions along the same axis in the width direction.

Further, the first detection sensor 61 is disposed closer than the second detection sensor 62 relative to the center. It is because the control using the first detection sensor 61 associated with the continuous feeding of the subsequent sheet P2 is considered to be more frequent than the control using the second detection sensor 62 that is not associated with the continuous feeding of the subsequent sheet P2.

In the present embodiment, as will be described below with reference to the flowchart of FIG. 9, based on the detection results of the first detection sensor 61 (i.e., the first detector or sensor) and the second detection sensor 62 (i.e., the second detector or sensor), the relation of the size between the widthwise size of the actually fed sheet P and the widthwise size of the sheet P recognized by the sheet feeding device 12 (the image forming apparatus 1) to be fed in advance (i.e., the size of the sheet P input by a user by operating an operation display panel 100) is determined, and a counter operation for the abnormal condition is performed in accordance with the relation of the size.

Specifically, in the present embodiment, in a case where the widthwise size of the actually fed sheet P is smaller than the widthwise size of the sheet P input to the operation display panel 100, if the print job (in other words, image forming process) is continued in the same circumstance, the size of the toner image (image) formed on the photoconductor drum 5 in the transfer process exceeds from the sheet P, resulting in contaminating the transfer device 7 with toner. In order to reduce such inconvenience, when the sheet feeding device 12 determines that the sheet P currently being conveyed is small, the sheet feeding device 12 causes the print job (sheet conveying operation) to immediately go to a forced interruption, so that a paper jam handling is performed by the user to remove the jammed sheet P. At this time, the operation display panel 100 displays, for example, the content of the failure and the method for the paper jam handling.

On the other hand, when the widthwise size of the actually fed sheet P is greater than the widthwise size of the sheet P input to the operation display panel 100, the inconvenience in which the transfer device 7 is contaminated with toner does not occur even if the print job is continued in the same circumstance, which is different from the case when the widthwise size of the actually fed sheet P is smaller than the widthwise size of the sheet P input to the operation display panel 100. For this reason, the sheet feeding device 12 does not cause the print job (sheet conveying operation) to go to a forced interruption but to continue to the end that is ejection of a sheet P having the large size to the ejection tray 31 (see FIG. 1). Due to such a configuration, a paper jam handling by a user is not required. At this time, the operation display panel 100 mostly displays the contents of the inconvenience.

The determination of the size of the sheet P in such control is described in detail below with reference to the flowchart of FIG. 9.

In the present embodiment, in the above-described controls using the first detection sensor 61, the second detection sensor 62, and the determination unit (i.e., the controller 80), in a case where the preceding sheet P1 to be fed has the widthwise size that cannot be detected (undetectable) by the first detection sensor 61 (i.e., the first detector or sensor), when the determination unit (i.e., the controller 80) determines that the trailing end of the preceding sheet P1 reaches the given position (i.e., the position illustrated in FIG. 5C), the feeding of the subsequent sheet P2 is started in response to the determination timing.

This control corresponds to steps S1 and S14 in the flowchart of FIG. 7 and step S13 in the flowchart of FIG. 8, which is described below.

As a result, even when a sheet P having a small widthwise size that cannot be detected by the first detection sensor 61 is fed, the failure of no feeding of the sheet P can be reduced.

On the other hand, in a case where the preceding sheet P1 to be fed has the widthwise size that can be detected by the first detection sensor 61 (i.e., the first detector or sensor) but cannot be detected by the second detection sensor 62 (i.e., the second detector or sensor), either of the following controls (1) and (2) is executed.

(1) When the trailing end of the preceding sheet P1 is detected by the first detection sensor 61, the feeding of the subsequent sheet P2 is started in response to the detection timing.

(2) When the trailing end of the preceding sheet P1 is not detected by the first detection sensor 61 and the determination unit (i.e., the controller 80) determines that the trailing end of the preceding sheet P1 reaches the given position (i.e., the position illustrated in FIG. 5C), the feeding of the subsequent sheet P2 is started in response to the determination timing.

The above-described control (1) corresponds to steps S2, S15, and S16 in the flowchart of FIG. 7 and steps S10 to S13 in the flowchart of FIG. 8, which is described below. On the other hand, the above-described control (2) corresponds to steps S2, S14, and S15 in the flowchart of FIG. 7 and step S13 in the flowchart of FIG. 8, which is described below. Due to such controls as described above, even when a relatively small sheet P having the widthwise size that cannot be detected by the second detection sensor 62 is fed, the failure of no feeding of the sheet P can be reduced.

Figure 7:
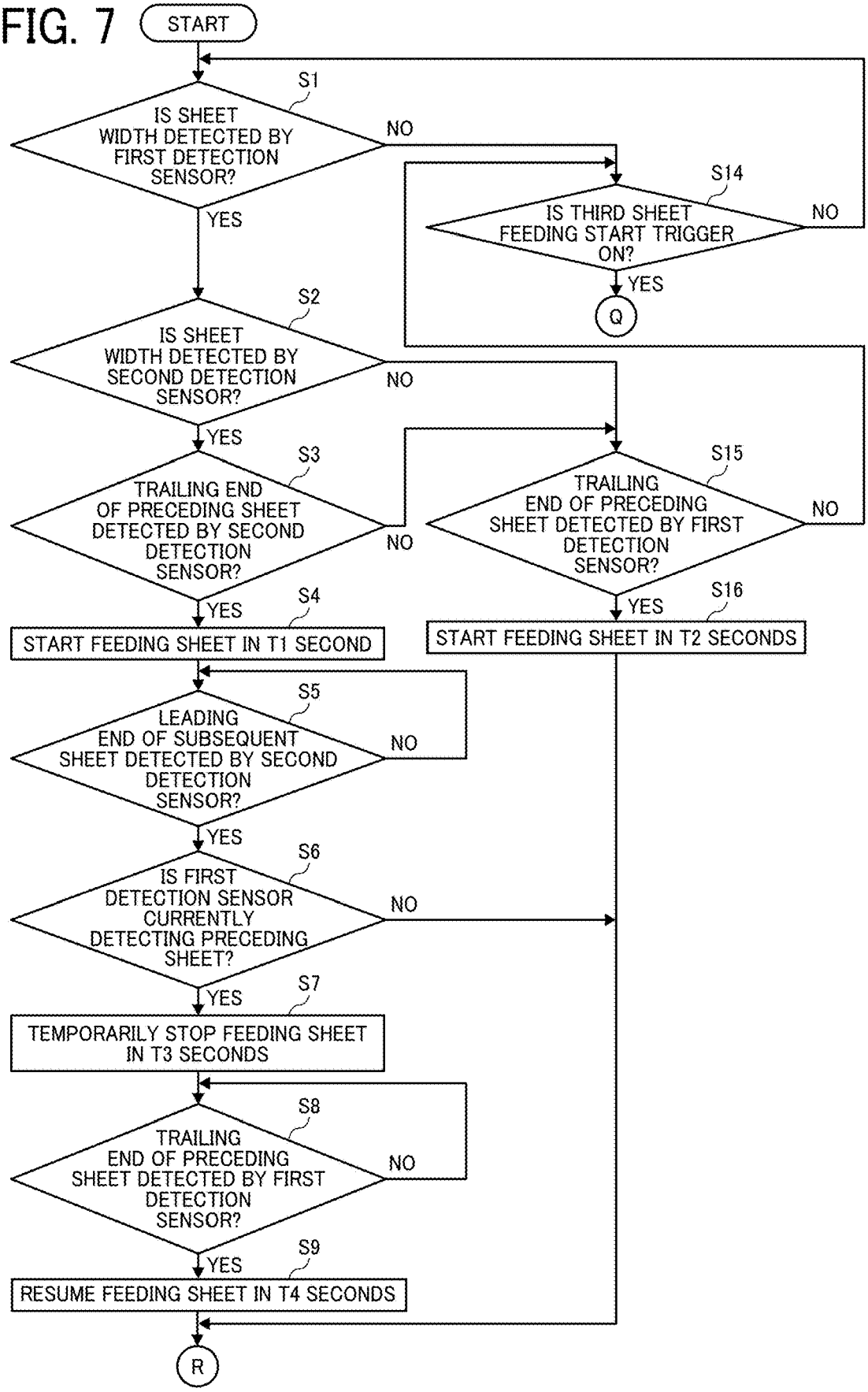
FIG. 7 is a flowchart of a control process of a continuous feeding in the sheet feeding device.
Figure 8:
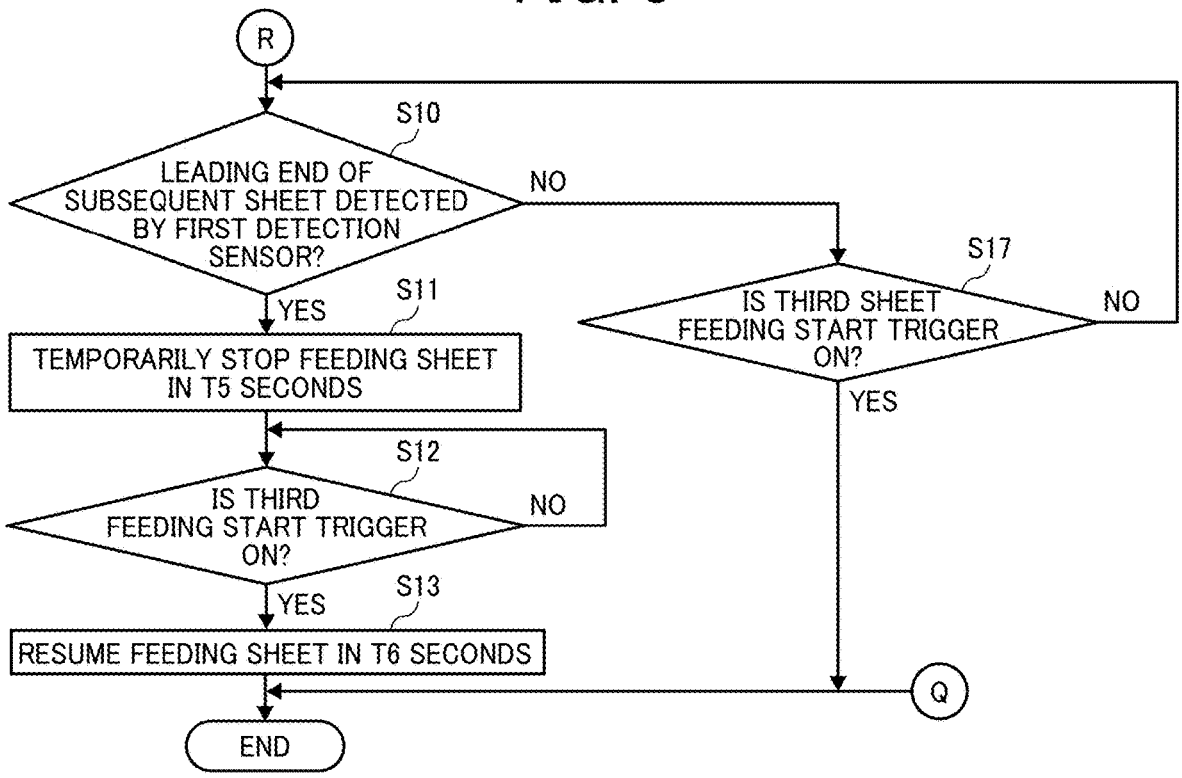
FIG. 8 is a flowchart of the control process subsequent from FIG. 7.

A description is now given of the control executed in the sheet feeding device 12 in continuous feeding (continuous printing), with reference to the flowcharts of FIGS. 7 and 8.

FIG. 7 is a flowchart of a control process of continuous feeding in the sheet feeding device 12.

FIG. 8 is a flowchart of the control process subsequent from FIG. 7.

As illustrated in FIG. 7, when the sheet feeding operation (printing operation) is started, the sheet feeding device 12 initially determines whether the width of a sheet P (i.e., the widthwise size of a sheet P) to be fed from the sheet feeding device 12 can be detected by the first detection sensor 61 (step S1). When the width of the sheet P to be fed from the sheet feeding device 12 can be detected by the first detection sensor 61 (YES in step S1), the sheet feeding device 12 further determines whether the width of the sheet P can be detected by the second detection sensor 62 (step S2).

As a result, when the width of the sheet P can be detected by the second detection sensor 62 (YES in step S2), the sheet feeding device 12 further determines whether the trailing end of the preceding sheet P1 is detected by the second detection sensor 62 (step S3), When the trailing end of the preceding sheet P1 is detected by the second detection sensor 62 (YES in step S3), the sheet feeding device 12 determines that any continuous feeding does not occur as illustrated in FIG. 5A, and starts the feeding of the subsequent sheet P2 in T1 second, in other words, after T1 second has elapsed (step S4). Then, the sheet feeding device 12 determines whether the leading end of the subsequent sheet P2 is detected by the second detection sensor 62 (step S5). When the leading end of the subsequent sheet P2 is not detected by the second detection sensor 62 (NO in step S5), step S5 is repeated until the leading end of the subsequent sheet P2 is detected by the second detection sensor 62. When the leading end of the subsequent sheet P2 is detected by the second detection sensor 62 (YES in step S5), the sheet feeding device 12 further determines whether the first detection sensor 61 is currently detecting the presence of the preceding sheet P1 (step S6).

As a result, when the first detection sensor 61 is not currently detecting the presence of the preceding sheet P1 (NO in step S6), the control goes to step S10. On the other hand, when the first detection sensor 61 is currently detecting the presence of the preceding sheet P1 (YES in step S6), the sheet feeding device 12 determines that the space (gap) between the preceding sheet P1 and the subsequent sheet P2 is too short and temporarily stops the feeding of the subsequent sheet P2 in T3 seconds, in other words, after T3 seconds have elapsed (step S7). Then, the sheet feeding device 12 determines whether the trailing end of the preceding sheet P1 is detected by the first detection sensor 61 (step S8). When the trailing end of the preceding sheet P1 is not detected by the first detection sensor 61 (NO in step S8), step S8 is repeated until the trailing end of the preceding sheet P1 is detected by the first detection sensor 61. When the trailing end of the preceding sheet P1 is detected by the first detection sensor 61 (YES in step S8), the feeding of the subsequent sheet P2 that is temporarily stopped is resumed (step S9).

After step S9, as illustrated in FIG. 8, the sheet feeding device 12 determines whether the leading end of the subsequent sheet P2 is detected by the first detection sensor 61 (step S10). When the leading end of the subsequent sheet P2 is detected by the first detection sensor 61 (YES in step S10), the sheet feeding device 12 determines that the space (gap) between the preceding sheet P1 and the subsequent sheet P2 is too short and temporarily stops the feeding of the subsequent sheet P2 in T5 seconds, in other words, after T5 seconds have elapsed (step S11).

After step S11, the sheet feeding device 12 determines whether the third sheet feeding start trigger is turned on (step S12). When the third sheet feeding start trigger is not turned on (NO in step S12), step S12 is repeated until the third sheet feeding start trigger is turned on. In other words, the determination unit (i.e., the controller 80) determines whether the trailing end of the preceding sheet P1 reaches the given position as illustrated in FIG. 5C.

After T6 seconds from when the third sheet feeding start trigger is turned on (YES in step S12), the sheet feeding device 12 resumes the feeding of the subsequent sheet P2 that has temporarily been stopped (step S13), and ends the control flow.

On the other hand, when the leading end of the subsequent sheet P2 is not detected by the first detection sensor 61 (NO in step S10), the sheet feeding device 12 determines whether the third sheet feeding start trigger is turned on (step S17). In other words, the determination unit (i.e., the controller 80) determines whether the trailing end of the preceding sheet P1 reaches the given position as illustrated in FIG. 5C. When the third sheet feeding start trigger is turned on (YES in step S17), the sheet feeding device 12 determines that the space (gap) between the preceding sheet P1 and the subsequent sheet P2 is sufficiently obtained and performs the steps after step S13. On the other hand, when the third sheet feeding start trigger is not turned on (NO in step S17), the control flow returns to step S10 to perform step S10 and the following steps again.

When the trailing end of the preceding sheet P1 is not detected by the second detection sensor 62 in step S3 of the flowchart in FIG. 7 (NO in step S3), the sheet feeding device 12 determines that the subsequent sheet P2 is continuously fed beyond the position of the second detection sensor 62. Based on this determination, the sheet feeding device 12 further determines whether the trailing end of the preceding sheet P1 is detected by the first detection sensor 61 (step S15). When the trailing end of the preceding sheet P1 is detected by the first detection sensor 61 (YES in step S15), the sheet feeding device 12 determines that the continuous feeding as illustrated in FIG. 5B occurs. Based on this determination, the sheet feeding device 12 starts the feeding of the subsequent sheet P2 in T2 seconds, in other words, after T2 seconds have elapsed (step S16). After step S16 of the flowchart in FIG. 7, step S10 of the flowchart in FIG. 8 and the subsequent steps are performed.

On the other hand, when the trailing end of the preceding sheet P1 is not detected by the first detection sensor 61 in step S15 of the flowchart in FIG. 7 (NO in step S15), the sheet feeding device 12 determines that the continuous feeding as illustrated in FIG. 5C occurs. Based on this determination, the sheet feeding device 12 determines whether the third sheet feeding start trigger is turned on (step S14). In other words, the determination unit (i.e., the controller 80) determines whether the trailing end of the preceding sheet P1 reaches the given position as illustrated in FIG. 5C. When the third feeding start trigger is turned on (YES in step S14), the flow after step S13 in FIG. 8 is performed. On the other hand, when the third sheet feeding start trigger is not turned on (NO in step S14), the control flow returns to step S1 in FIG. 7 to perform step S1 and the following steps again.

When the width of the fed sheet P cannot be detected by the second detection sensor 62 in step S2 of the flowchart in FIG. 7 (NO in step S2), the sheet feeding device 12 determines that the control to start the feeding of the subsequent sheet P2 based on the detection result of the second detection sensor 62 cannot be executed. In response to the determination, the control flow goes to step S15 to perform step S15 and the following steps. In other words, the control to start the feeding of the subsequent sheet P2 based on the detection result of the first detection sensor 61 and the determination result of the determination unit (i.e., the controller 80) is performed.

When the width of the fed sheet P cannot be detected by the first detection sensor 61 in step S1 of the flowchart in FIG. 7 (NO in step S1), the sheet feeding device 12 determines that the control to start the feeding of the subsequent sheet P2 based on the detection result of the first detection sensor 61 (and the second detection sensor 62) cannot be executed. In response to the determination, the control flow goes to step S14 to perform step S14 and the following steps. In other words, the control to start the feeding of the subsequent sheet P2 based on the determination result of the determination unit (i.e., the controller 80) is performed.

Figure 9:
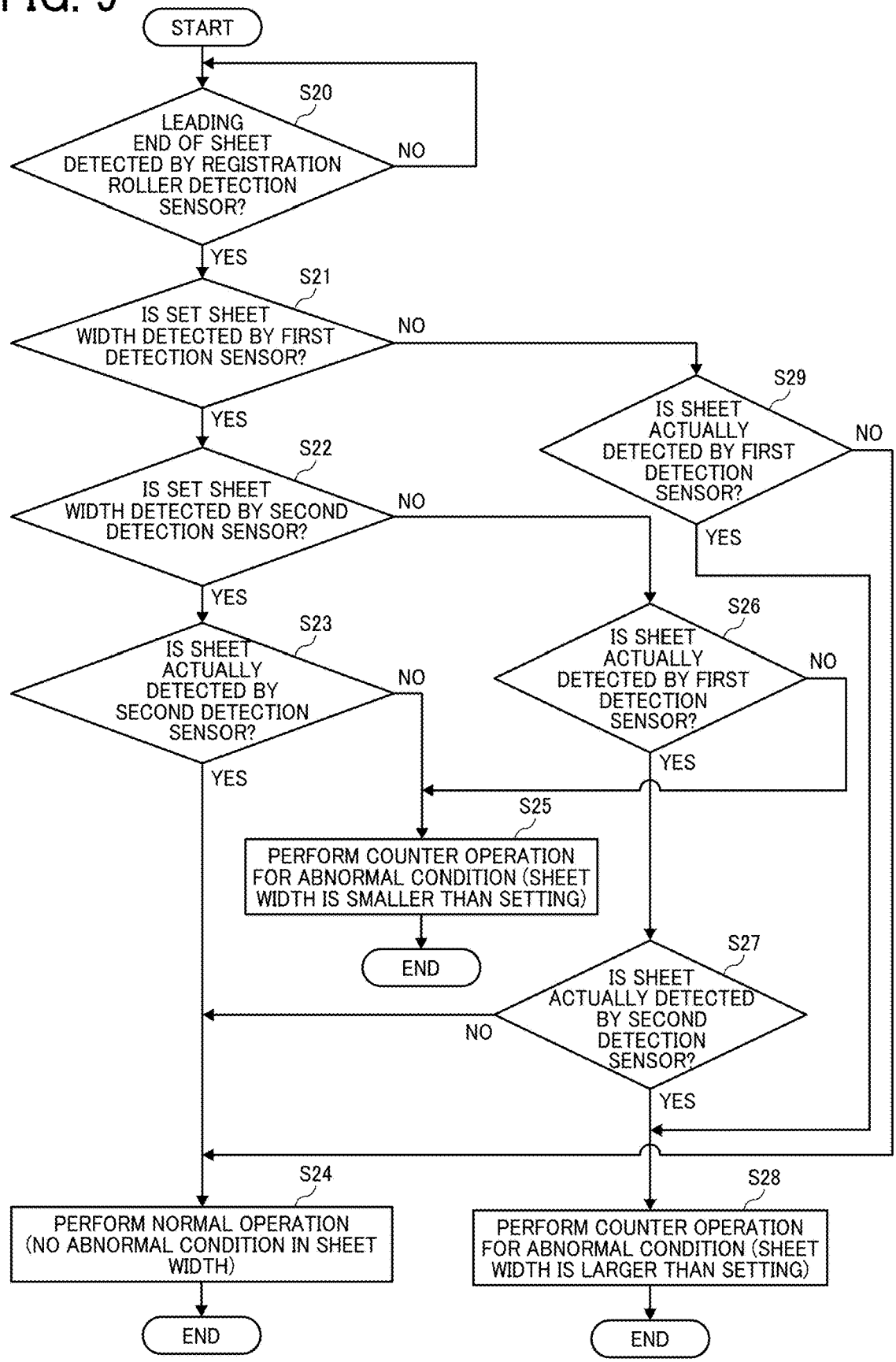
FIG. 9 is a flowchart of the control process of detecting the abnormality of the size of a sheet fed from the sheet feeding device.

A description is now given of the control of detecting abnormality in size of the sheet P fed from the sheet feeding device 12, with reference to the flowchart of FIG. 9.

FIG. 9 is a flowchart of a control process of detecting the abnormality of the size of a sheet fed from the sheet feeding device 12.

As illustrated in FIG. 9, when the sheet feeding operation (not limited to the continuous sheet feeding operation) is started, the sheet feeding device 12 initially determines whether the leading end of the sheet P is detected by the registration roller detection sensor 63 (step S20), Unlike the first detection sensor 61 and the second detection sensor 62, the registration roller detection sensor 63 is disposed at a position where the registration roller detection sensor 63 can detect sheets P whose widthwise sizes are passable through the entire width direction (i.e., the widthwise center position).

When the leading end of the sheet P is not detected by the registration roller detection sensor 63 (NO in step S20), step S20 is repeated until the leading end of the sheet P is detected by the registration roller detection sensor 63. When the leading end of the sheet P is detected by the registration roller detection sensor 63 (YES in step S20), the sheet feeding device 12 determines whether the width of the set sheet P (i.e., the widthwise size input to the operation display panel 100) is detectable by the first detection sensor 61 (step S21).

When the width of the set sheet P is detectable by the first detection sensor 61 (YES in step S21), the sheet feeding device 12 further determines whether the width of the set sheet P is detected by the second detection sensor 62 (step S22). When the width of the set sheet P is detectable by the second detection sensor 62 (YES in step S22), the sheet feeding device 12 determines whether the sheet P is actually detected by the second detection sensor 62 (step S23). When the sheet P is actually detected by the second detection sensor 62 (YES in step S23), the sheet feeding device 12 determines that the width (i.e., the widthwise size) of the sheet P set in the operation display panel 100 matches the width (i.e., the widthwise size) of the sheet P actually fed. Based on the determination, the sheet feeding device 12 performs the normal operation, in other words, the sheet feeding device 12 determines that no abnormal condition is in the width of the sheet P (step S24). In other words, the normal sheet feeding operation (print job) is continued.

On the other hand, when the sheet P is not actually detected by the second detection sensor 62 in step S23 (NO in step S23), the sheet feeding device 12 determines that the width (i.e., the widthwise size) of the sheet P actually fed is smaller than the width (i.e., the widthwise size) of the sheet P set in the operation display panel 100. Based on the determination, the sheet feeding device 12 performs the counter operation for the abnormal condition (step S25). As described above, the counter operation for the abnormal condition is to forcibly stop the printing operation in order to prevent contamination in the transfer device 7. In addition, the sheet feeding device 12 notifies the user of the abnormal condition through the operation display panel 100.

When the width of the set sheet P is not detectable by the second detection sensor 62 in step S22 in FIG. 9 (NO in step S22), the sheet feeding device 12 determines whether the first detection sensor 61 actually detects the sheet P (step S26). As a result, when the first detection sensor 61 has not actually detected the sheet P (NO in step S26), the sheet feeding device 12 determines that the width of the sheet P actually fed is smaller than the set sheet P. The control flow goes to step S25 to perform step S25 and the following steps.

On the other hand, when the first detection sensor 61 has actually detected the sheet P (YES in step S26), the sheet feeding device 12 further determines whether the second detection sensor 62 actually detects the sheet P (step S27). As a result, when the second detection sensor 62 has not actually detected the sheet P (NO in step S27), the sheet feeding device 12 determines that no abnormal condition is in the width of the sheet P actually fed. Based on the determination, step S24 is performed. On the other hand, when the second detection sensor 62 has actually detected the sheet P (YES in step S27), the sheet feeding device 12 determines that the width (i.e., the widthwise size) of the sheet P actually fed is greater than the width the widthwise size) of the sheet P set in the operation display panel 100. Based on the determination, the sheet feeding device 12 performs the counter operation for the abnormal condition (step S28). As described above, the counter operation for the abnormal condition in this case is to forcibly stop the priming operation and eject the sheets P having different sizes to the ejection tray 31, so as to prevent contamination in the transfer device 7. In addition, the sheet feeding device 12 notifies the user of the abnormal condition through the operation display panel 100.

When the width of the sheet P set in the operation display panel 100 is not detectable by the first detection sensor 61 in step S21 of the flowchart in FIG. 9 (NO in step S21), the sheet feeding device 12 further determines whether the first detection sensor 61 actually detects the sheet P (step S29). As a result, when the first detection sensor 61 does not actually detect the sheet P (NO in step S29), the sheet feeding device 12 determines that no abnormal condition is in the width of the sheet P actually fed. Based on the determination, step S24 is performed. On the other hand, when the first detection sensor 61 actually detects the sheet P (YES in step S29), the sheet feeding device 12 determines that the width of the sheet P actually fed is greater than the width of the sheet P set in the operation display panel 100. Based on the determination, the sheet feeding device 12 performs the counter operation for the abnormal condition (step S28).

In the present embodiment, as described in step S20, the sheet feeding device 12 determines whether the sheet size is normal or abnormal in response to the detection of the leading end of the sheet P by the registration roller detection sensor 63. However, the sheet size of the sheet P is not limited to the determination in response to the detection of the leading end of the sheet P by the registration roller detection sensor 63, according to the present embodiment. For example, the sheet feeding device 12 may determine whether the sheet size is normal or abnormal in response to the detection of the sheet P by any other sheet detection sensors.

Modification

Figure 10:
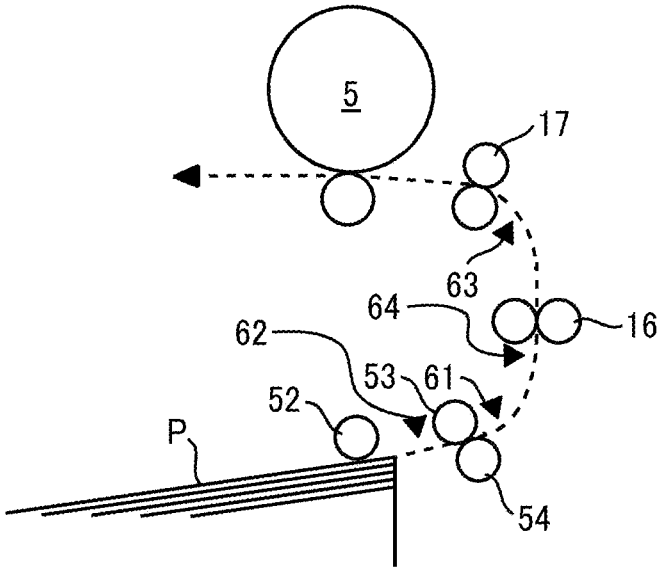
FIG. 10 is a schematic diagram illustrating a sheet conveyance passage from the sheet feeding device to the transfer device, according to a modification of the present disclosure.

A description is now given of the sheet feeding device 12 according to a modification of the present embodiment, with reference to FIG. 10.

FIG. 10 is a schematic diagram illustrating a sheet conveyance passage from the sheet feeding device 12 to the transfer portion, according to a modification of the present disclosure.

Figure 11:
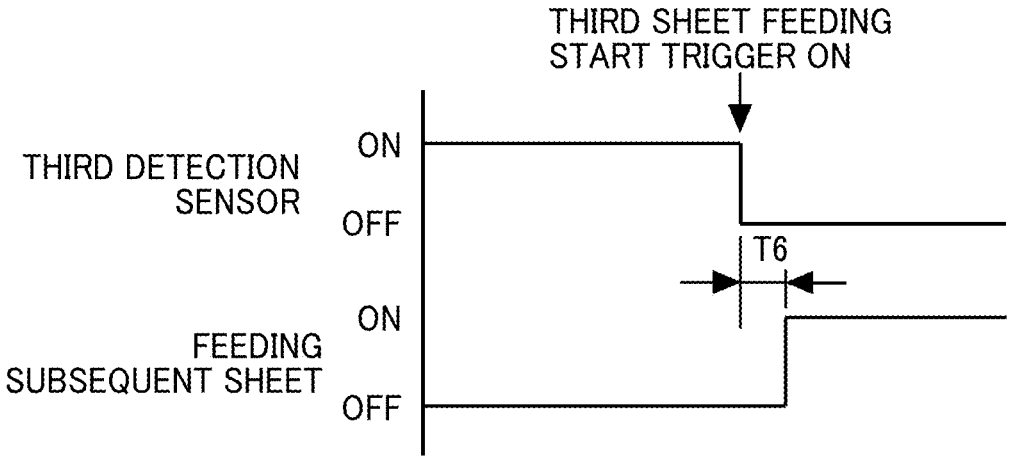
FIG. 11 is a timing chart of a control process to start feeding a subsequent sheet in the sheet feeding device of FIG. 10.

FIG. 11 is a timing chart of a control to start feeding a subsequent sheet in the sheet feeding device 12 of FIG. 10.

As illustrated in FIG. 10, the sheet feeding device 12 (the image forming apparatus 1) according to the modification includes the determination unit that is disposed at the given position (i.e., the position where the trailing end of the preceding sheet P1 can be detected as illustrated in FIG. 5C) and determines that the trailing end of the preceding sheet P1 reaches at the given position illustrated in FIG. 5C, based on the detection result of the third detection sensor 64 serving as a third detector or sensor that can detect a sheet.

In other words, in the modification, it is not to estimate the state where the trailing end of the preceding sheet P1 reaches the given position as illustrated in FIG. 5C, based on the timing at which the registration roller pair 17 starts driving, but the state where the trailing end of the preceding sheet P1 reaches the given position as illustrated in FIG. 5C is directly detected by the third detection sensor 64. Then, as illustrated in FIG. 11, in response to the timing at which the third detection sensor 64 detects the trailing end of the preceding sheet P1 (i.e., the third sheet feeding start trigger), the sheet feeding device 12 start the feeding of the subsequent sheet P2 (the driving of the sheet feeding assembly 51) after T6 seconds have elapsed from the third sheet feeding start trigger.

For example, similar to the first detection sensor 61 and the second detection sensor 62, the third detection sensor 64 may be a reflective photosensor.

Even in a case where the third detection sensor 64 (i.e., the third detector or sensor) is used as the determination unit, the failure such as no sheet feeding of the sheets P can be less likely to occur.

As described above, the sheet feeding device 12 according to the present embodiment includes the sheet stacker 42 that can stack multiple sheets P, the pickup roller 52 (serving as a first sheet feeder) that feeds the sheet P stacked on the sheet stacker 42, the sheet feed roller 53 (serving as a second sheet feeder) that further feeds the sheet P that is fed by the pickup roller 52, and the sheet separation roller 54 (serving as a sheet separation member) that contacts the sheet feed roller 53 to form a nip region. The first detection sensor 61 (serving as a first detector or sensor) that can detect a sheet is disposed downstream from the nip region in the sheet conveyance direction. The second detection sensor 62 (serving as a second detector or sensor) that can detect a sheet P is disposed downstream from the pickup roller 52 and upstream from the nip region in the sheet conveyance direction. The determination unit (i.e., the controller 80 or the third detection sensor 64) that can determine that the trailing end of the sheet P reaches the given position is disposed downstream from the first detection sensor 61 by the given distance X. When the trailing end of the preceding sheet P1 is detected by the second detection sensor 62, the feeding of the subsequent sheet P2 is started in response to the detection timing. On the other hand, when the trailing end of the preceding sheet P1 is not detected by the second detection sensor 62 but is detected by the first detection sensor 61, the feeding of the subsequent sheet P2 is started in response to the detection timing. Further, when the trailing end of the preceding sheet P1 is not detected by the first detection sensor 61 and the determination unit determines that the trailing end of the preceding sheet P1 reaches the given position, the feeding of the subsequent sheet P2 is started in response to the determination timing.

Such a configuration can reduce or prevent occurrence of no sheet feeding of the sheet P.

The above-described embodiments of the present disclosure are applied to the sheet feeding device 12 provided for the image forming apparatus 1 that is a monochrome image forming apparatus. However, the present disclosure is not limited to the above-described sheet feeding device (that is, the sheet feeding device 12). For example, the present disclosure is also applicable to a sheet feeding device provided for a color image forming apparatus.

Further, the above-described embodiments of the present disclosure are applied to the sheet feeding device 12 provided for the image forming apparatus 1 that employs electrophotography. However, the present disclosure is not limited to the above-described sheet feeding device (that is, the sheet feeding device 12). For example, the present disclosure is also applicable to a sheet feeding device provided for an image forming apparatus that employs an inkjet method or a stencil printing machine.

Further, the above-described embodiments of the present disclosure are applied to the sheet feeding device 12 inside the image forming apparatus 1. However, the present disclosure is not limited to the above-described sheet feeding device (that is, the sheet feeding device 12). For example, the present disclosure is also applicable to a sheet feeding device disposed as an exterior exposed outside of the image forming apparatus 1 (for example, the bypass sheet feeding device 13) or a document feeding device such as the document feeding device 10 (serving as an automatic document feeder) that feeds (conveys) the original document D as a sheet.

Furthermore, the above-described embodiments of the present disclosure are applied to the sheet feeding device 12 provided for the image forming apparatus 1. However, the present disclosure is not limited to the above-described sheet feeding device (that is, the sheet feeding device 12). For example, the present disclosure is also applicable to a scanner provided with a sheet feeding device that feeds (automatically conveys) the original document D as a sheet.

Further, the above-described embodiments of the present disclosure are applied to the sheet feeding device provided with rollers as a first sheet feeder and a second sheet feeder. However, the present disclosure is not limited to the above-described sheet feeding device (that is, the sheet feeding device 12). For example, the present disclosure is also applicable to a sheet feeding device provided with belts as a first sheet feeder and a second sheet feeder.

Further, the above-described embodiments of the present disclosure are applied to the sheet feeding device 12 including the controller 80 that serves as a determination unit. However, the present disclosure is not limited to the above-described configuration. For example, the controller 80 may be disposed in the image forming apparatus 1 instead of the sheet feeding device 12. In such a case, the controller 80 included in the image forming apparatus 1 may be function as a controller that controls the overall operation of the image forming apparatus 1.

Any of the cases described above exhibits substantially the same advantages as the advantages of the present embodiment.

Note that embodiments of the present disclosure are not limited to the above-described embodiments and it is apparent that the above-described embodiments can be appropriately modified within the scope of the technical idea of the present disclosure in addition to what is suggested in the above-described embodiments. The number, position, and shape of the components described above are not limited to those embodiments described above. Desirable number, position, and shape can be determined to perform the present disclosure.

In the present description, the term "sheet" is defined as any sheet-like recording medium, such as general paper, coated paper, label paper, overhead projector (OHP) transparency, or a film sheet.

Further, in the present description, the terms "preceding sheet" and "subsequent sheet" have a relation as a sheet to be fed in advance and another sheet to be fed following the sheet fed in advance, out of multiple sheets to be continuously fed from a sheet feeding device. Accordingly, for example, when three sheets are continuously fed as a "first sheet", a "second sheet", and a "third sheet" in this order, the second sheet serves as a subsequent sheet relative to the first sheet serving as a preceding sheet, and the second sheet serves as a preceding sheet relative to the third sheet serving as a subsequent sheet.

ASPECTS OF THE PRESENT DISCLOSURE

Aspects of the present disclosure may be, for example, as follows.

Aspect 1

In Aspect 1, a sheet feeding device includes a stacker, a first feeder, a second feeder, a first sensor, a second sensor, and circuitry. The sheet stacker stacks multiple sheets including a sheet. The first feeder feeds the sheet stacked on the sheet stacker in a sheet conveyance direction. The second feeder further feeds the sheet fed by the first feeder in the sheet conveyance direction. The separation roller contacts the second feeder to form a nip region. The first sensor detects the sheet and is disposed downstream from the nip region in the sheet conveyance direction. The second sensor detects the sheet and is disposed downstream from the first feeder in the sheet conveyance direction and upstream from the nip region in the sheet conveyance direction. The circuitry is to determine that a trailing end of the sheet reaches at a given position downstream from the first sensor in the sheet conveyance direction, start feeding a subsequent sheet fallowing the sheet in response to detection of the trailing end of the sheet by the second sensor when the second sensor detects the trailing end of the sheet, detection of the trailing end of the sheet by the first sensor when the second sensor does not detect the trailing end of the sheet and the first sensor detects the trailing end of the sheet, or determination that the trailing end of the sheet reaches at the given position when the first sensor does not detect the trailing end of the sheet.

Aspect 2

In Aspect 2, according to Aspect 1, the circuitry is to determine that the trailing end of the sheet reaches the given position when a given time has elapsed from when conveyance of the sheet is started toward a downstream side in the sheet conveyance direction by a registration roller pair.

Aspect 3

In Aspect 3, the sheet feeding device according to Aspect 1 further includes a third sensor to detect the sheet at the given position. The circuitry is to determine that the trailing end of the sheet reaches at the given position based on detection by the third sensor.

Aspect 4

In Aspect 4, according to any one of Aspects 1 to 3, when the first sensor is changed from a non-detection state to a detection state, the circuitry is to temporarily stop the subsequent sheet, determine that the trailing end of the sheet at the given position, and resume conveyance of the subsequent sheet.

Aspect 5

In Aspect 5, according to any one of Aspects 1 to 4, the circuitry is to temporarily stop conveyance of the subsequent sheet, while the first sensor detects the sheet, when the second sensor is changed from a first state where the second sensor does not detect the subsequent sheet to a second state where the second sensor detects the subsequent sheet after starting the feeding of the subsequent sheet in response to the detection of the trailing end of the sheet by the second sensor, resume feeding the subsequent sheet after the first sheet is changed from a first state where the first sensor detects the sheet to a second state where the first sensor does not detect the sheet.

Aspect 6

In Aspect 6, according to any one of Aspects 1 to 5, the first sensor is at a position away from a center position in a width direction of the sheet perpendicular to the sheet conveyance direction and is detectable of a sheet equal to or greater than a first widthwise size, and the second sensor is disposed at a position close to an end in the width direction of the sheet relative to the first sensor and is detectable of a sheet equal to or greater than a second widthwise size greater than the first widthwise size.

Aspect 7

In Aspect 7, according to Aspect 6, the circuitry is to determine whether the widthwise size of the fed sheet is larger than the widthwise size of the sheet recognized by the apparatus to be fed in advance, based on detections of the first sensor and the second sensor, and execute a counter operation for the abnormal condition is performed in accordance with the determination.

Aspect 8

In Aspect 8, according to Aspects 6 or 7, the circuitry is to start feeding the subsequent sheet in response to determination that the trailing end of the sheet reaches at the given position when the sheet having a widthwise size undetectable by the first sensor is ted, detection of the trailing end of the sheet by the first sensor when the sheet having a widthwise size detectable by the first sensor and undetectable by the second sensor is fed, or determination that the trading end of the sheet reaches at the given position when the first sensor does not detect the trailing end of the sheet.

Aspect 9

In Aspect 9, the sheet feeding device according to any one of Aspects 1 to 8 further includes a downstream conveyance roller pair disposed downstream from the second feeder in the sheet conveyance direction. The first sensor is disposed downstream from the nip region in the sheet conveyance direction and upstream from the downstream conveyance roller pair in the sheet conveyance direction.

Aspect 10

In Aspect 10, an image forming apparatus includes the sheet feeding device according to any one of Aspects 1 to 9.

Aspect 11

In Aspect 11, a sheet feeding device includes a sheet stacker, a first feeder, a second feeder, a separation member, a first sensor, a second sensor, and circuitry. The sheet stacker stacks multiple sheets including a first sheet and a second sheet below the first sheet on the sheet stacker. The first feeder is over the sheet stacker to feed the multiple sheets on the sheet stacker in a sheet conveyance direction. The second feeder is downstream from the first feeder in the sheet conveyance direction to feed the multiple sheets fed from the first feeder in the sheet conveyance direction. The separation member contacts the second feeder to form a nip region. The first sensor is disposed downstream from the nip region in the sheet conveyance direction to detect the first sheet or the second sheet. The second sensor is disposed downstream from the first feeder and upstream from the nip region in the sheet conveyance direction to detect the first sheet or the second sheet. The circuitry is to determine that a trailing end of the first sheet reaches at a given position downstream from the first sensor in the sheet conveyance direction, and start feeding the second sheet following the first sheet in response to one of (1) detecting the trailing end of the first sheet by the second sensor, (2) detecting the trailing end of the first sheet by the first sensor and not detecting the trailing end of the first sheet by the second sensor, and (3) determining that the trailing end of the first sheet reaches at the given position and not detecting the trailing end of the first sheet by the first sensor and the second sensor.

Aspect 12

In Aspect 12, the sheet feeding device according to Aspect 11 further includes a registration roller pair downstream from the nip region to convey the first sheet in the sheet conveyance direction. The circuitry is further to determine that the trailing end of the first sheet reaches the given position after an elapse of given time from a start of conveyance of the first sheet by the registration roller pair in the sheet conveyance direction.

Aspect 13

In Aspect 13, the sheet feeding device according to Aspect 12 further includes a third sensor downstream from the first sensor and upstream from the registration roller pair to detect the multiple sheets at the given position. The circuitry is further to determine that the trailing end of the sheet reaches at the given position in response to detecting the first sheet by the third sensor.

Aspect 14

In Aspect 14, according to Aspect 11, in response to a change in a state from not detecting the second sheet to detecting the second sheet by the first sensor. The circuitry is further to temporarily stop a feeding of the second sheet, and resume conveyance of the second sheet after determining that the trailing end of the sheet reaches the given position.

Aspect 15

In Aspect 15, according to Aspect 11, in response to a change in a state from not detecting the second sheet to detecting the second sheet by the second sensor after start feeding the second sheet, and detecting the first sheet by the first sensor, the circuitry is to temporarily stop conveyance of the second sheet, and resume feeding the second sheet after the change in the state from detecting the first sheet to not detecting the first sheet by the first sensor.

Aspect 16

In Aspect 16, according to Aspect 11, the first sensor is at a position separated from a center position in a width direction of the sheet perpendicular to the sheet conveyance direction and is detectable a sheet equal to or greater than a first widthwise size. Further, the second sensor is at a position farther from the center position than the first sensor in the width direction, and is detectable a sheet equal to or greater than a second widthwise size greater than the first widthwise size in the width direction.

Aspect 17

In Aspect 17, according to Aspect 16, the circuitry is further to determine an abnormal condition in comparison of a widthwise size of the multiple sheets detected by the first sensor and the second sensor and a widthwise size of the multiple sheets set in advance, and temporarily stop conveyance of the multiple sheets in response to determining of the abnormal condition.

Aspect 18

In Aspect 18, according to Aspect 16, the circuitry is further to start feeding the second sheet in response to determining that the trailing end of the first sheet reaches at the given position when the first sheet having a widthwise size smaller than a detectable range of the first sensor in the width direction is fed to the nip region.

Aspect 19

In Aspect 19, according to Aspect 16, the circuitry is further to start feeding the second sheet in response to detecting the trailing end of the first sheet by the first sensor when the sheet having a widthwise size larger than a detectable range of the first sensor and smaller than a detectable range of the second sensor in the width direction is fed to the nip region.

Aspect 20

In Aspect 20, according to Aspect 16, the circuitry is further to start feeding the second sheet in response to determining that the trailing end of the sheet reaches at the given position and not detecting the trailing end of the first sheet by the first sensor.

Aspect 21

In Aspect 21, the sheet feeding device according to Aspect 12 further includes a downstream conveyance roller pair downstream from the nip region and upstream from the registration roller pair in the sheet conveyance direction. The first sensor is downstream from the nip region in the sheet conveyance direction and upstream from the downstream conveyance roller pair in the sheet, conveyance direction.

Aspect 22

In Aspect 22, an image forming apparatus includes the sheet feeding device according to Aspect 11.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device comprising:

a sheet stacker to stack multiple sheets including a first sheet and a second sheet below the first sheet on the sheet stacker;

a first feeder over the sheet stacker to feed the multiple sheets on the sheet stacker in a sheet conveyance direction;

a second feeder downstream from the first feeder in the sheet conveyance direction to feed the multiple sheets fed from the first feeder in the sheet conveyance direction;

a separation structure contacting the second feeder to form a nip region;

a first sensor disposed downstream from the nip region in the sheet conveyance direction to detect the first sheet or the second sheet;

a second sensor disposed downstream from the first feeder and upstream from the nip region in the sheet conveyance direction to detect the first sheet or the second sheet; and circuitry configured to:

determine that a trailing end of the first sheet reaches at a given position downstream from the first sensor in the sheet conveyance direction; and start feeding the second sheet following the first sheet in response to:

(1) detecting the trailing end of the first sheet by the second sensor;

start feeding the second sheet following the first sheet in response to:

(2) detecting the trailing end of the first sheet by the first sensor and not detecting the trailing end of the first sheet by the second sensor; and start feeding the second sheet following the first sheet in response to:

(3) determining that the trailing end of the first sheet reaches at the given position and not detecting the trailing end of the first sheet by the first sensor and the second sensor.

2. The sheet feeding device according to claim 1, further comprising a registration roller pair downstream from the nip region to convey the first sheet in the sheet conveyance direction, wherein the circuitry is further configured to determine that the trailing end of the first sheet reaches the given position after an elapse of given time from a start of conveyance of the first sheet by the registration roller pair in the sheet conveyance direction.

3. The sheet feeding device according to claim 2, further comprising a third sensor downstream from the first sensor and upstream from the registration roller pair to detect the multiple sheets at the given position, wherein the circuitry is further configured to determine that the trailing end of the first sheet reaches at the given position in response to detecting the first sheet by the third sensor.

4. The sheet feeding device according to claim 1, wherein, in response to a change in a state from not detecting the second sheet to detecting the second sheet by the first sensor, the circuitry is further configured to:

temporarily stop a feeding of the second sheet; and resume conveyance of the second sheet after determining that the trailing end of the second sheet reaches the given position.

5. The sheet feeding device according to claim 1, wherein, in response to:

a change in a state from not detecting the second sheet to detecting the second sheet by the second sensor after start feeding the second sheet; and detecting the first sheet by the first sensor, the circuitry is configured to:

temporarily stop conveyance of the second sheet; and resume feeding the second sheet after the change in the state from detecting the first sheet to not detecting the first sheet by the first sensor.

6. The sheet feeding device according to claim 1, wherein:

the first sensor is at a position separated from a center position in a width direction of the sheet perpendicular to the sheet conveyance direction, the first sensor is detectable a sheet equal to or greater than a first widthwise size, the second sensor is at a position farther from the center position than the first sensor in the width direction, and the second sensor is detectable a sheet equal to or greater than a second widthwise size greater than the first widthwise size in the width direction.

7. The sheet feeding device according to claim 6, wherein the circuitry is further configured to:

determine an abnormal condition in comparison of a widthwise size of the multiple sheets detected by the first sensor and the second sensor and a widthwise size of the multiple sheets set in advance; and temporarily stop conveyance of the multiple sheets in response to determining of the abnormal condition.

8. The sheet feeding device according to claim 6, wherein the circuitry is further configured to start feeding the second sheet in response to determining that the trailing end of the first sheet reaches at the given position when the first sheet having a widthwise size smaller than a detectable range of the first sensor in the width direction is fed to the nip region.

9. The sheet feeding device according to claim 6, wherein the circuitry is further configured to start feeding the second sheet in response to detecting the trailing end of the first sheet by the first sensor when the first sheet having a widthwise size larger than a detectable range of the first sensor and smaller than a detectable range of the second sensor in the width direction is fed to the nip region.

10. The sheet feeding device according to claim 6, wherein the circuitry is further configured to start feeding the second sheet in response to determining that the trailing end of the first sheet reaches at the given position and not detecting the trailing end of the first sheet by the first sensor.

11. The sheet feeding device according to claim 2, further comprising:

a downstream conveyance roller pair downstream from the nip region and upstream from the registration roller pair in the sheet conveyance direction, wherein the first sensor is downstream from the nip region in the sheet conveyance direction and upstream from the downstream conveyance roller pair in the sheet conveyance direction.

12. An image forming apparatus comprising the sheet feeding device according to claim 1.

13. A sheet feeding device comprising:

a sheet stacker to stack multiple sheets including a first sheet and a second sheet below the first sheet on the sheet stacker;

a first feeder over the sheet stacker to feed the multiple sheets on the sheet stacker in a sheet conveyance direction;

a second feeder downstream from the first feeder in the sheet conveyance direction to feed the multiple sheets fed from the first feeder in the sheet conveyance direction;

a separation structure contacting the second feeder to form a nip region;

a first sensor disposed downstream from the nip region in the sheet conveyance direction to detect the first sheet or the second sheet;

a second sensor disposed downstream from the first feeder and upstream from the nip region in the sheet conveyance direction to detect the first sheet or the second sheet; and circuitry configured to:

determine that a trailing end of the first sheet reaches at a given position downstream from the first sensor in the sheet conveyance direction;

start feeding the second sheet following the first sheet in response to:

(1) detecting the trailing end of the first sheet by the second sensor;

start feeding the second sheet following the first sheet in response to:

(2) detecting the trailing end of the first sheet by the first sensor and not detecting the trailing end of the first sheet by the second sensor; and start feeding the second sheet following the first sheet in response to:

(3) determining that the trailing end of the first sheet reaches at the given position and not detecting the trailing end of the first sheet by the first sensor and the second sensor; and in a case that width of the first sheet is not detected by the first sensor, the sheet feeding device starts feeding the second sheet following the first sheet in response to determining that the trailing end of the first sheet reaches at the given position and not detecting the trailing end of the first sheet by the first sensor and the second sensor.

14. A sheet feeding device comprising:

a sheet stacker to stack multiple sheets including a first sheet and a second sheet below the first sheet on the sheet stacker;

a first feeder over the sheet stacker to feed the multiple sheets on the sheet stacker in a sheet conveyance direction;

a second feeder downstream from the first feeder in the sheet conveyance direction to feed the multiple sheets fed from the first feeder in the sheet conveyance direction;

a separation structure contacting the second feeder to form a nip region;

a first sensor disposed downstream from the nip region in the sheet conveyance direction to detect the first sheet or the second sheet;

a second sensor disposed downstream from the first feeder and upstream from the nip region in the sheet conveyance direction to detect the first sheet or the second sheet; and circuitry configured to:

determine that a trailing end of the first sheet reaches at a given position downstream from the first sensor in the sheet conveyance direction; and start feeding the second sheet following the first sheet in response to one of:

(1) detecting the trailing end of the first sheet by the second sensor;

(2) detecting the trailing end of the first sheet by the first sensor and not detecting the trailing end of the first sheet by the second sensor; and (3) determining that the trailing end of the first sheet reaches at the given position and not detecting the trailing end of the first sheet by the first sensor and the second sensor, wherein:

the first sensor is at a position separated from a center position in a width direction of the sheet perpendicular to the sheet conveyance direction, the first sensor is detectable a sheet equal to or greater than a first widthwise size, the second sensor is at a position farther from the center position than the first sensor in the width direction, and the second sensor is detectable a sheet equal to or greater than a second widthwise size greater than the first widthwise size in the width direction.

* * * * *